US009296226B2

(12) United States Patent
Aruga et al.

(10) Patent No.: US 9,296,226 B2
(45) Date of Patent: Mar. 29, 2016

(54) PRINTER, AND PAPER POSITION DETECTION METHOD OF A PRINTER

(71) Applicant: Seiko Epson Corporation, Tokyo (JP)

(72) Inventors: Yuichi Aruga, Okaya (JP); Hiroshi Yabe, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/511,949

(22) Filed: Oct. 10, 2014

(65) Prior Publication Data

US 2015/0103127 A1 Apr. 16, 2015

(30) Foreign Application Priority Data

| | | |
|---|---|---|
| Oct. 11, 2013 | (JP) | 2013-213469 |
| Jul. 9, 2014 | (JP) | 2014-141186 |
| Jul. 9, 2014 | (JP) | 2014-141187 |
| Sep. 3, 2014 | (JP) | 2014-178820 |

(51) Int. Cl.
*B41J 11/00* (2006.01)

(52) U.S. Cl.
CPC ..... *B41J 11/0095* (2013.01)

(58) Field of Classification Search
None
See application file for complete search history.

(56) References Cited

U.S. PATENT DOCUMENTS

| | | | | |
|---|---|---|---|---|
| 2010/0061745 | A1 | 3/2010 | Ito et al. | |
| 2012/0075376 | A1 * | 3/2012 | Murray et al. | 347/16 |
| 2014/0292926 | A1 * | 10/2014 | Aruga et al. | 347/37 |

FOREIGN PATENT DOCUMENTS

| | | | |
|---|---|---|---|
| JP | 11-227176 | A | 8/1999 |
| JP | 2007-118438 | A | 5/2007 |
| JP | 2007-130802 | A | 5/2007 |
| JP | 2010-064266 | A | 3/2010 |
| JP | 2011-016309 | A | 1/2011 |

* cited by examiner

*Primary Examiner* — Manish S Shah
*Assistant Examiner* — Renee I Wilson
(74) *Attorney, Agent, or Firm* — Nutter McClennen & Fish LLP; John J. Penny, Jr.

(57) ABSTRACT

Airborne ink mist is prevented from sticking to the detector part of a paper detector disposed on a carriage without using a configuration for capturing the ink mist. A printer has a conveyance path that conveys paper past the print position of a printhead; a carriage that carries the printhead; and a carriage moving mechanism that moves the carriage bidirectionally on the transverse axis of the printer. A paper detector and a shutter that opens and closes the detection part of the paper detector are disposed on the carriage. When the carriage moves to one end of the range of carriage movement, a shutter operating member disposed on a second side frame facing the carriage contacts the shutter and moves the shutter from its open position or closed position to the other position.

8 Claims, 21 Drawing Sheets

PRINTER, AND PAPER POSITION DETECTION METHOD OF A PRINTER

This application claims priority under 35 U.S.C. §119 to Japanese Patent Application No. 2013-213469 filed Oct. 11, 2013, 2014-141187 filed Jul. 9, 2014, 2014-141186 filed Jul. 9, 2014 and 2014-178820 filed Sep. 3, 2014, the entire disclosures of which are expressly incorporated by reference herein.

BACKGROUND

1. Technical Field

The present invention relates to a printer having a paper detector mounted on a carriage, and to a paper position detection method of a printer.

2. Related Art

Printing paper is conveyed in a serial printer through a conveyance path past the print position of the printhead, and the position where printing is to start on the printing paper is set to the print position. Thereafter, the printing operation that moves the printhead across the width of the conveyance path perpendicularly to the conveyance direction of the printing paper, and the paper feed operation that conveys the printing paper in increments of a specific conveyance distance through the conveyance path, repeat alternately. The printhead is mounted on a carriage, and the carriage is moved bidirectionally in the transverse direction (widthwise to the conveyance path) by a carriage moving mechanism. Executing a printing process with high positioning precision in a preset print area on the printing paper requires accurately knowing the position of the printing paper when positioning the paper. Serial printers therefore commonly have a paper detector mounted on the carriage so that the paper detector can detect the leading end of the printing paper as it passes the print position, and the position of at least one widthwise edge of the printing paper at the print position.

The paper detector typically has an optical device as the detection part with an emitter that emits a detection beam toward the print position and a photodetector that receives the detection beam reflected from the printing paper. When the printhead of the serial printer is an inkjet head, some of the ink droplets ejected from the printhead may become dispersed as airborne ink mist inside the case before reaching the printing paper.

This ink mist can easily stick to the detection part of the paper detector carried on the carriage, and as the amount of ink mist on the detection part increases, the emitter and the photodetector may become covered with ink and unable to detect the position of the printing paper on the conveyance path when detection is required.

JP-A-2007-130802 discloses technology to suppress the ink mist from sticking to parts inside the case. More specifically, JP-A-2007-130802 teaches putting a fan and a filter inside the case, and capturing ink mist with the filter using the air flow produced by the fan.

Installing a fan and filter for capturing ink mist in a printer obviously requires installation space, and complicates making the printer smaller. A power source for driving the fan is also required, and leads to increasing the manufacturing cost of the printer.

SUMMARY

A printer according to one aspect of at least one embodiment of the invention has a conveyance path that conveys printing paper in a first direction; a printhead that ejects ink and prints on the printing paper; a carriage that carries the printhead; a carriage moving mechanism that moves the carriage in a second direction perpendicularly to the first direction; a paper detector that is disposed on the carriage and that has an emission part that emits light and a detection part that detects light; and a shutter that moves between a closed position covering the detection part of the paper detector, and an open position different from the closed position.

The carriage that carries the printhead also includes a paper detector and a shutter that covers the detection part of the paper detector. By covering the detection part of the paper detector with the shutter, ink mist can be prevented from sticking to the detection part even when there is airborne ink mist inside the case. The printer therefore does not require a separate configuration to capture the ink mist in order to prevent ink mist from sticking to the detection part of the paper detector. The size of the printer can therefore be reduced, and printer manufacturing cost can be suppressed.

A printer according to another aspect of at least one embodiment of the invention preferably also has a shutter operating member that moves the shutter when the carriage is in a specific position.

In this aspect of the invention, the carriage has a shutter operating member for opening and closing the shutter. The shutter can therefore be moved to the closed position or the open position by the shutter operating member, and by covering the detection part of the paper detector with the shutter, ink mist can be prevented from sticking to the detection part even when ink mist becomes airborne inside the case. The shutter is also opened and closed by movement of the carriage. The printer therefore does not need an actuator or other drive mechanism to open and close the shutter.

Another aspect of at least one embodiment of the invention is a paper position detection method of a printer, including: conveying printing paper in a first direction; moving a carriage carrying a printhead that ejects ink and a photodetector including an emission part that emits light and a detection part that detects light in a second direction perpendicularly to the first direction; detecting the printing paper by the photodetector; and covering the detection part with the shutter when the carriage has moved to a specific position in the second direction.

When detecting the printing paper is necessary in this aspect of the invention, the shutter is set to the open position and whether or not printing paper is present is detected. When detecting the printing paper is not necessary, the shutter can be set to the closed position. The detection part of the paper detector can therefore be covered with the shutter when not detecting the printing paper, and ink mist can be prevented from sticking to the detection part even in an environment where ink mist becomes airborne.

A paper position detection method of a printer according to another aspect of at least one embodiment of the invention further includes detecting the edges of the printing paper based on the detection output of the photodetector.

This aspect of the invention can position the paper in the conveyance direction because the leading end of the printing paper is detected when supplying the printing paper to the conveyance path. The paper can also be set to a precise print position because the widthwise edges of the printing paper are also detected when printing starts.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer 1 according to at least one embodiment of the present invention is described below with reference to the accompanying figures.

General Configuration

Figure 1:
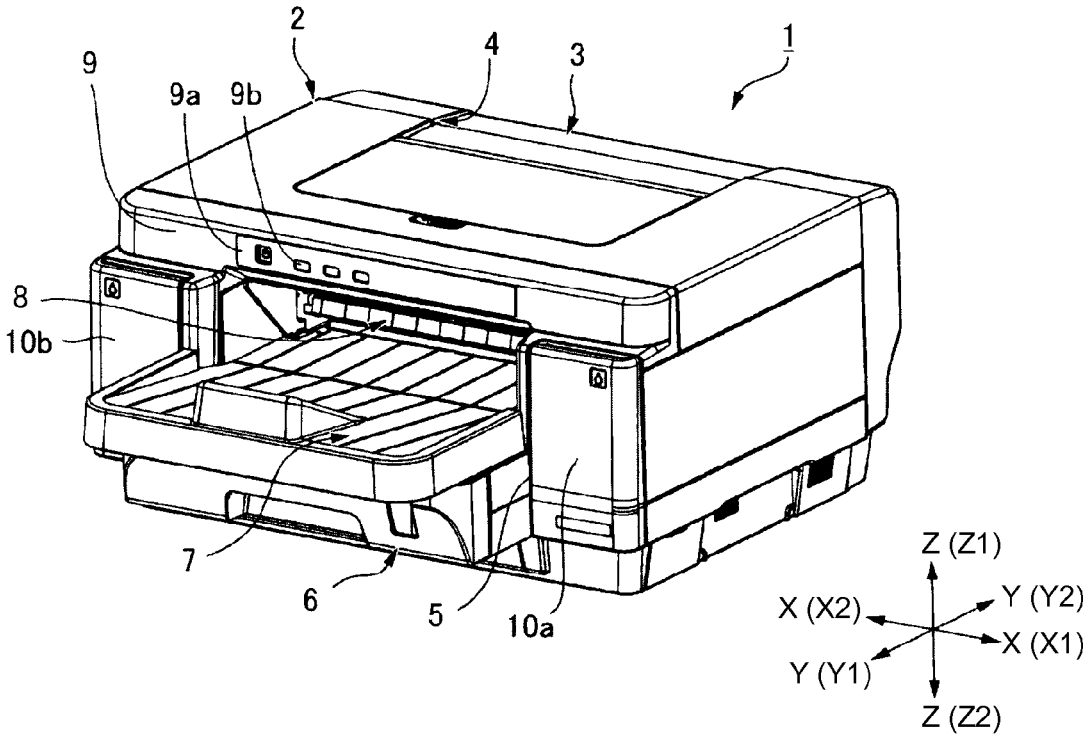
FIG. 1 is an oblique view of a printer according to a preferred embodiment of the invention.

FIG. 1 is an external oblique view from the paper exit 8 side (referred to below as the front) of the printer 1 according to the first embodiment of the invention. The printer 1 has a printer cabinet 2 and an inverting unit 3 installed near a recess 4 in the middle of the back of the printer cabinet 2. The inverting unit 3 is a unit that reverses the front and back sides of the printing paper P.

A paper cassette loading unit 5 is disposed on the front of the printer cabinet 2. The paper cassette loading unit 5 opens to the printer front Y1 (the front on the longitudinal axis Y) at a position toward the bottom on the vertical axis Z in the front of the printer cabinet 2. A paper cassette 6 can be installed from the printer front Y1 into the paper cassette loading unit 5. A paper discharge tray 7 is attached to the top of the paper cassette loading unit 5. The front end of the paper discharge tray 7 protrudes to the printer front Y1 from the printer cabinet 2. A rectangular paper exit 8 is formed extending toward the printer back Y2 above the paper discharge tray 7.

As described above, when the printer 1 is installed normally on a horizontal surface with the paper exit 8 to the front, the x-axis denotes the transverse axis aligned with the printer width, the y-axis denotes the longitudinal axis between the front and back of the printer, and the z-axis denotes the vertical axis perpendicular to the x-axis and y-axis. On the y-axis, Y1 denotes the printer front Y1 and Y2 denotes the printer back Y2. On the z-axis, Z1 is the direction of the printer top Z1, and Z2 is the direction of the printer bottom Z2. Note that the x-axis is perpendicular to the y-axis, and the z-axis is perpendicular to the x-axis and the y-axis. These directions apply to the other figures and the following description of the invention.

The case 9 of the printer cabinet 2 has an operating panel 9*a* above the paper exit 8. The operating panel 9*a* includes a power switch and other operating buttons 9*b*. Rectangular access doors 10*a*, 10*b* are attached to the front of the case 9 on opposite sides of the paper discharge tray 7 and paper exit 8. When the access doors 10*a*, 10*b* are open, the ink cartridge loading unit 10 (see FIG. 3) opens and the ink cartridges (not shown in the figure) can be replaced.

Figure 2:
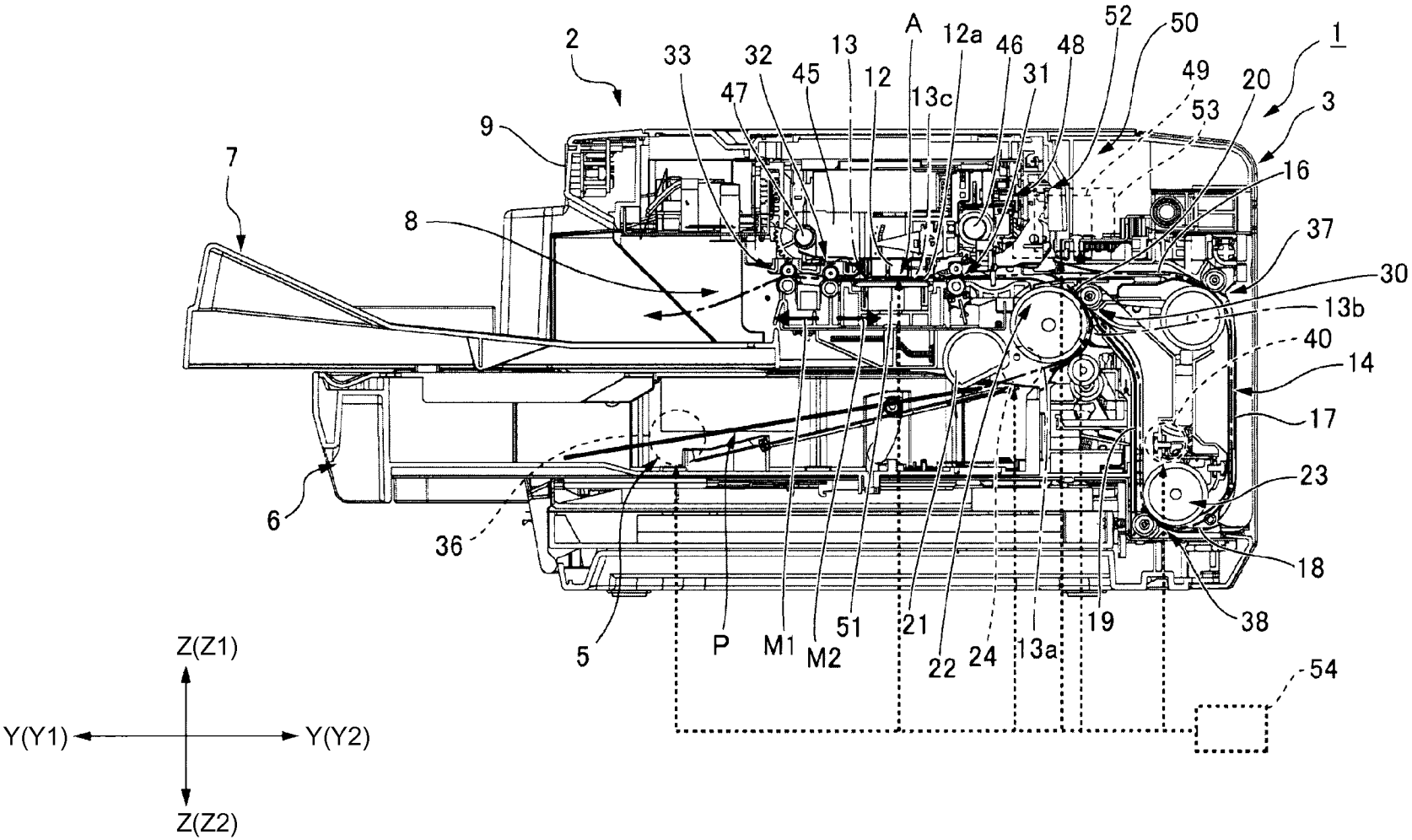
FIG. 2 is a vertical section view showing the internal configuration of the printer.

FIG. 2 is a vertical section view illustrating the internal configuration of the printer 1. A conveyance path 13 that extends from the paper cassette 6 past the print position A of the printhead 12 to the paper exit 8, and an inverting conveyance path 14 that reverses the printing paper P front and back, are formed inside the printer 1. The conveyance path 13 is disposed on the longitudinal axis Y of the printer cabinet 2, and the inverting conveyance path 14 is disposed in the inverting unit 3.

The conveyance path 13 is divided into the following conveyance path parts.

(a) A sloped conveyance path portion 13*a* rising diagonally toward the printer back Y2 from the back end of the paper cassette loading unit 5 (the position opposite the opening on the longitudinal axis Y) where the paper cassette 6 is installed (b) A curved conveyance path portion 13*b* that curves continuously from the back end of the sloped conveyance path portion 13*a* up and around toward the printer front Y1

(C) A horizontal conveyance path portion 13*c* extending substantially horizontally from the top front end of the curved conveyance path portion 13*b* toward the printer front Y1. The horizontal conveyance path portion 13*c* passes the print position A of the 12 and continues to the paper exit 8.

The inverting conveyance path 14 is a loop that connects continuously to the horizontal conveyance path portion 13*c*. The inverting conveyance path 14 includes an upstream path 16, a descending path 17, a bottom path 18, and an ascending path 19. The upstream path 16 extends substantially horizontally to the printer back Y2 on the longitudinal axis Y. The descending path 17 curves and extends down in a straight line from the upstream path 16. The bottom path 28 connects to the descending path 17 and curves to the printer front Y1. The ascending path 29 curves and extends upward from the bottom path 18. The top part of the ascending path 19 curves at an angle toward the printer front Y1, and merges with the curved conveyance path portion 13*b*. Part of the ascending path 19 and part of the curved conveyance path portion 13*b* are a common path 20.

Inside the printer 1 are a paper feed roller 21 that supplies printing paper P stored in a stack in the paper cassette 6 to the conveyance path 13, a conveyance mechanism 22 that conveys the printing paper P through the conveyance path 13, and a inverting conveyance mechanism 23 that conveys the printing paper P through the inverting conveyance path 14.

The paper feed roller 21 is located above the back end part of the paper cassette 6 on the longitudinal axis Y. The paper feed roller 21 turns as driven by the paper feed motor 24, and feeds the printing paper P to the conveyance path 13.

The conveyance mechanism 22 includes a first paper feed roller pair 30, a second paper feed roller pair 31, a first discharge roller pair 32, and a second discharge roller pair 33.

The first paper feed roller pair 30, second paper feed roller pair 31, first discharge roller pair 32, and second discharge roller pair 33 are disposed in order from the upstream side to the downstream side in the first conveyance direction M1 between the paper cassette 6 and the paper exit 8. The first paper feed roller pair 30 is disposed on the curved conveyance path portion 13*b*, and the second paper feed roller pair 31, the first discharge roller pair 32, and the second discharge roller pair 33 are disposed on the horizontal conveyance path portion 13*c*.

The drive source of the conveyance mechanism 22 is a conveyance motor 36 that is driven in forward or reverse. The conveyance motor 36 is a DC motor, and is disposed beside the paper cassette 6 on the transverse axis X.

The conveyance mechanism 22 conveys the printing paper P in the first conveyance direction M1 toward the paper exit 8 when the conveyance motor 36 is driven in the forward direction. When the conveyance motor 36 is driven in reverse, the conveyance mechanism 22 conveys the printing paper P in the second conveyance direction M2, which is the reverse of the first conveyance direction M1.

The inverting conveyance mechanism 23 conveys the printing paper P fed from the horizontal conveyance path portion 13*c* into the upstream path 16 by the conveyance mechanism 22 in one direction through the inverting conveyance path 14, and returns the printing paper P from the ascending path 19 to the horizontal conveyance path portion 13*c*. The inverting conveyance mechanism 23 includes a first inverting conveyance roller pair 37 disposed between the upstream path 16 and the descending path 17, and a second inverting conveyance roller pair 38 disposed between the bottom path 18 and the ascending path 19. The drive source of the inverting conveyance mechanism 23 is an inverting conveyance motor 40 separate from the conveyance motor 36, and is mounted in the inverting unit 3.

The printhead 12 is an inkjet head. The printhead 12 is mounted on the carriage 45 with the nozzle face 12*a* facing down. The carriage 45 is supported slidably on a carriage guide rail 46 and a carriage support rail 47 that extend substantially horizontally on the transverse axis X above the horizontal conveyance path portion 13*c*. A platen 51 is disposed below the printhead 12 with a specific gap therebetween. The platen 51 determines the print position A.

The carriage guide rail 46 and carriage support rail 47 are parallel to each other, and the carriage guide rail 46 is disposed behind the carriage support rail 47 on the printer back Y2 side. A carriage drive mechanism 48 that moves the carriage 45 bidirectionally on the transverse axis X along the carriage guide rail 46 and the carriage support rail 47 is disposed behind the carriage guide rail 46 on the printer back Y2 side. The drive source of the carriage drive mechanism 48 is a carriage motor 49. The carriage guide rail 46, the carriage support rail 47, the carriage drive mechanism 48, and the carriage motor 49 embody a carriage moving mechanism 50. The carriage 45 and the carriage moving mechanism 50 are disposed above the horizontal conveyance path portion 13*c*.

A carriage lift mechanism 52 that moves the carriage 45 up and down is also disposed above the horizontal conveyance path portion 13*c*. The carriage lift mechanism 52 moves the carriage 45 and the printhead 12 up and down by moving the carriage guide rail 46 and the carriage support rail 47 up and down on the vertical axis Z. The carriage lift mechanism 52 moves the carriage 45 between a first position 45A (not shown in the figure) where the gap between the platen 51 and the printhead 12 is a first distance, and a second position 45B where this gap is a second distance that is greater than the first distance. The drive source of the carriage lift mechanism 52 is a lift motor 53. The lift motor 53 is disposed on the transverse axis X on the opposite side of the horizontal conveyance path portion 13*c* as the carriage motor 49.

The printer 1 also has a control unit 54 including a CPU and memory. The control unit 54 controls driving the printhead 12, the carriage motor 49, the conveyance motor 36, the inverting conveyance motor 40, and the lift motor 53 based on print data supplied from an external host device (not shown in the figure).

When print data is supplied from the external device (a host device not shown), the control unit 54 controls driving the lift motor 53 based on the paper type of the printing paper P contained in the print data to move the carriage 45 and set the gap between the printhead 12 and the platen 51 to the first distance or the second distance. The control unit 54 also drives the paper feed motor 24 to drive the paper feed roller 21 and feed printing paper P stored in the paper cassette 6 to the conveyance path 13. The control unit 54 also drives the conveyance motor 36 in the forward direction to convey the printing paper P fed into the conveyance path 13 in the first conveyance direction M1 by means of the conveyance mechanism 22. The control unit 54 controls conveyance to set the intended start printing position on the printing surface of the printing paper P to the print position A.

The control unit 54 then controls the printhead 12, the carriage motor 49, and the conveyance motor 36 to apply the printing process to the surface of the printing paper P as it passes the print position A. The printing operation that ejects ink droplets toward the printing paper P while moving the printhead 12 on the transverse axis X, and the paper feed operation that advances the printing paper P a specific paper feed distance by means of the conveyance mechanism 22, execute alternately in the printing process.

When the printing process ends, the control unit 54 drives the conveyance motor 36 in reverse. The control unit 54 also drives the inverting conveyance motor 40. As a result, the printing paper P is conveyed in the second conveyance direction M2 by the conveyance mechanism 22, and is fed from the conveyance path 13 into the inverting conveyance path 14. The printing paper P fed into the inverting conveyance path 14 is then conveyed through the inverting conveyance path 14 by the inverting conveyance mechanism 23, and is returned to the conveyance path 13 with the front and back sides of the printing paper P reversed.

The control unit 54 stops driving the conveyance motor 36 in reverse when feeding the printing paper P into the inverting conveyance path 14 ends. The control unit 54 then drives the conveyance motor 36 in the forward direction before the printing paper P is returned to the conveyance path 13. As a result, the printing paper P returned to the conveyance path 13 is conveyed in the first conveyance direction M1 by the conveyance mechanism 22. Next, the control unit 54 sets the intended start printing position on the back (reverse) side of the printing paper P to the print position A.

Next, the control unit 54 drives the printhead 12, the carriage motor 49, and the conveyance motor 36 to apply the printing process to the second side of the printing paper P as it passes the print position A. The printing operation that ejects ink droplets toward the printing paper P while moving the printhead 12 on the transverse axis X, and the paper feed operation that advances the printing paper P a specific paper feed distance by means of the conveyance mechanism 22, execute alternately in the printing process.

When the process of printing on the second side of the printing paper P ends, the control unit 54 continues driving the conveyance motor 36 to further convey the printing paper P in the first conveyance direction M1 and discharge the printing paper P from the paper exit 8 by means of the conveyance mechanism 22.

Carriage Moving Mechanism

Figure 3:
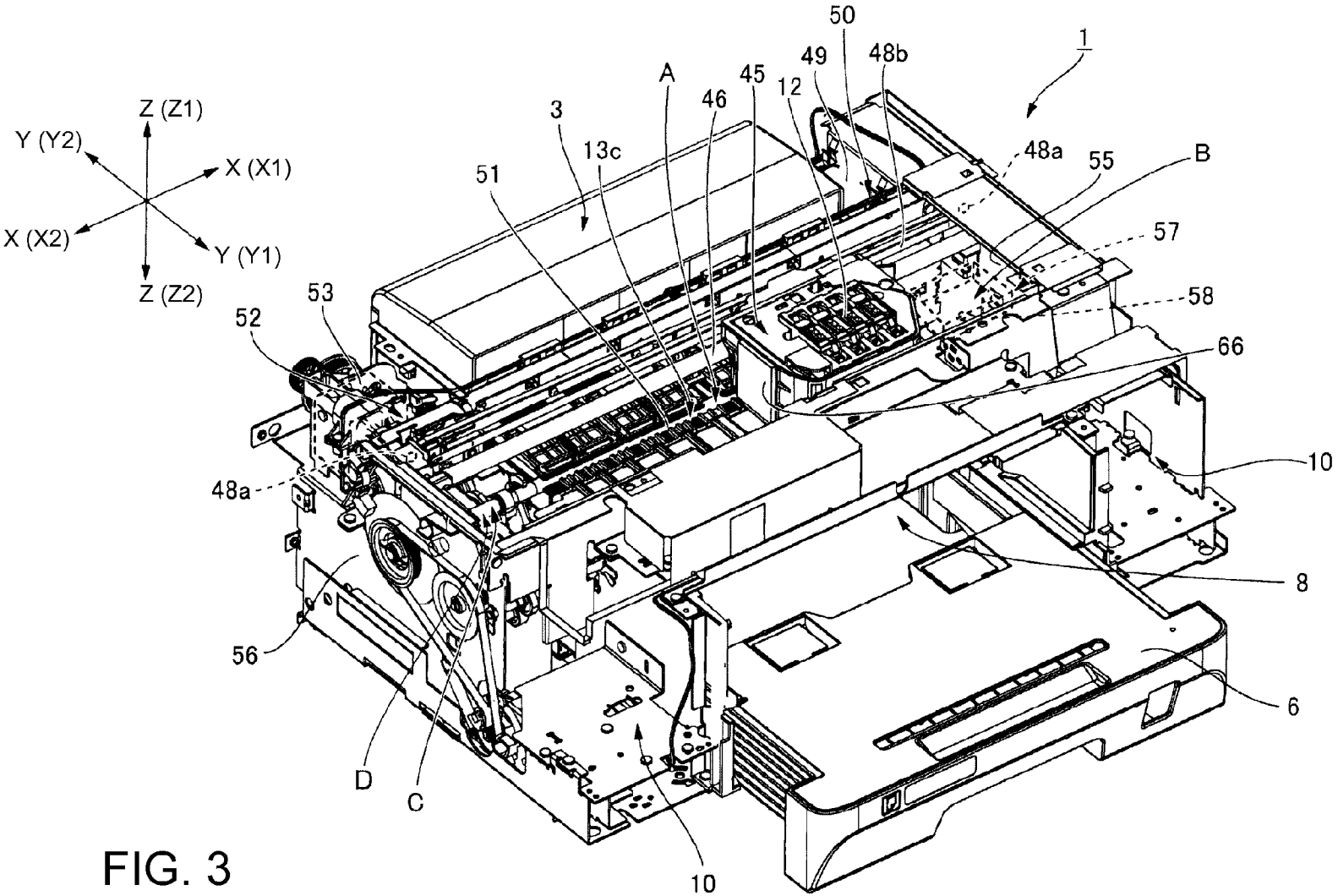
FIG. 3 is an oblique view from the front of the printer with the case and the paper discharge tray removed.
Figure 4:
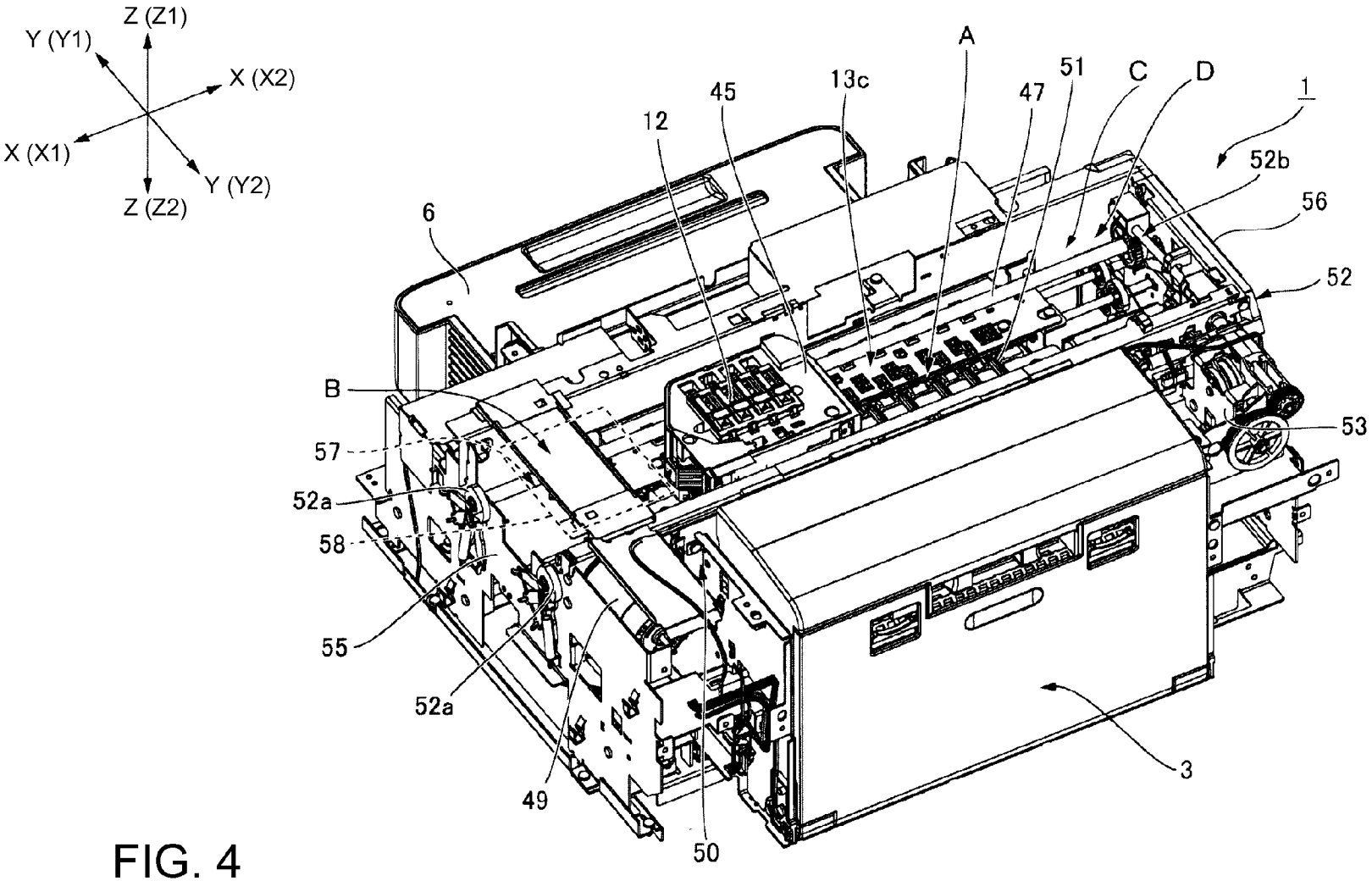
FIG. 4 is an oblique view from the back of the printer with the case and the paper discharge tray removed.
Figure 5:
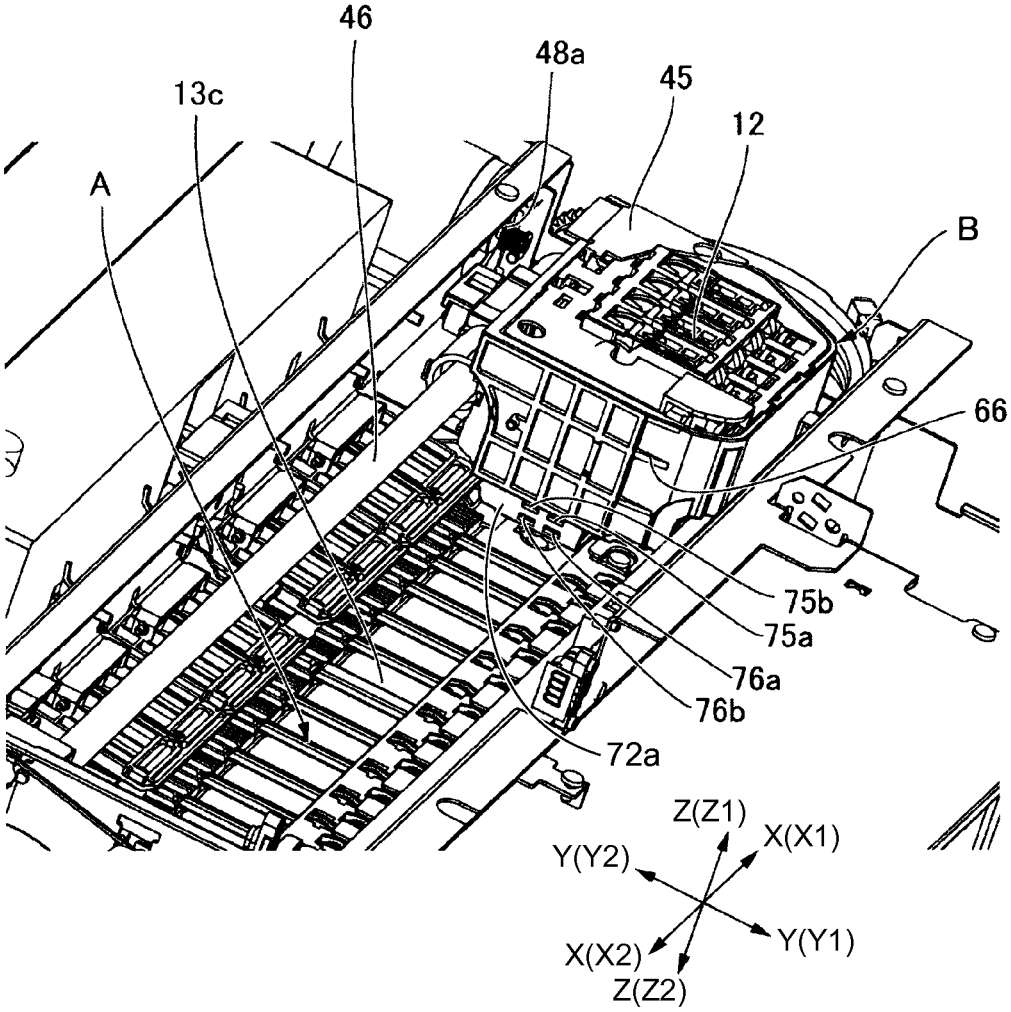
FIG. 5 is an oblique view of the carriage when set to the home position in a first embodiment of the invention.
Figure 6:
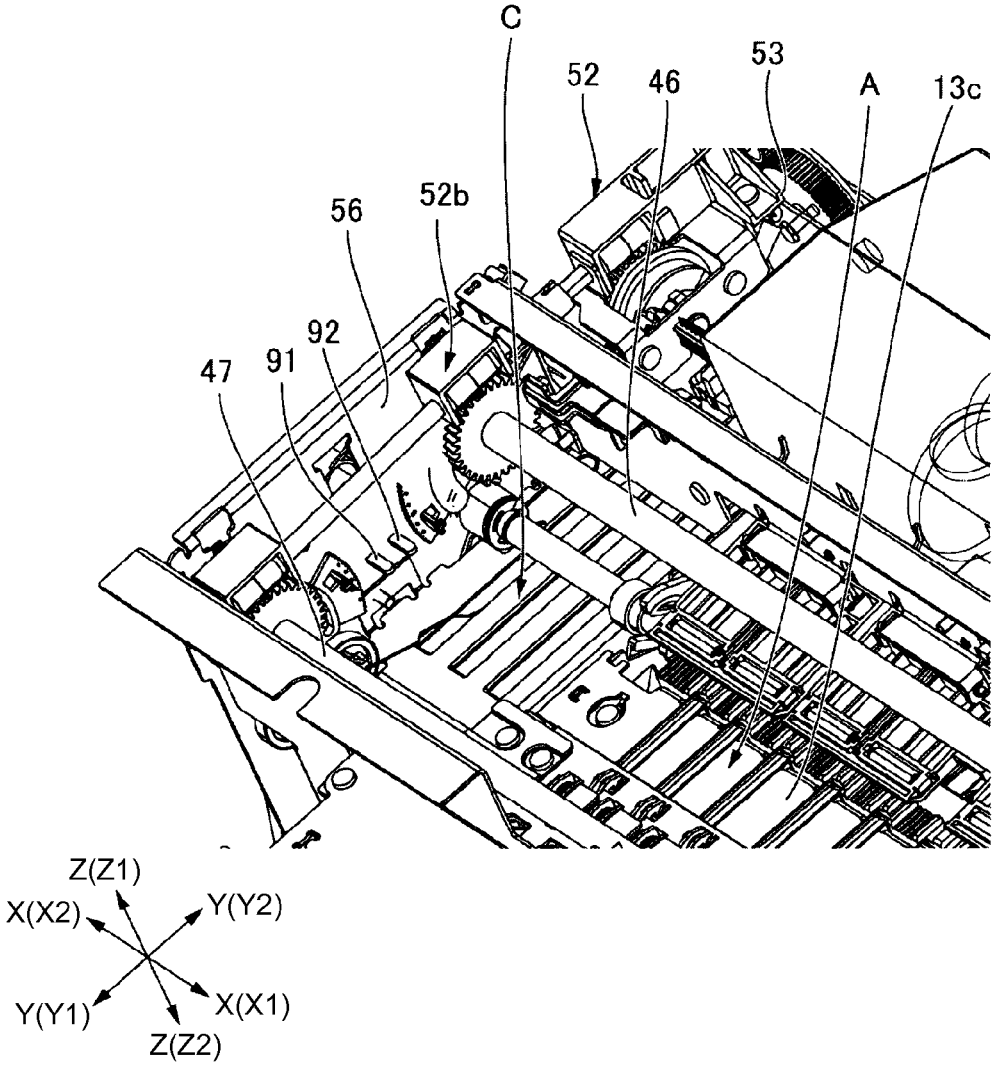
FIG. 6 is an oblique view of the area around the away position as seen from the horizontal conveyance path portion in a first embodiment of the invention.

The carriage 45, the carriage moving mechanism 50, and the carriage lift mechanism 52 are described in further detail below with reference to FIG. 3 to FIG. 6. FIG. 3 is an oblique view of the printer 1 from diagonally above the printer front Y1 without the case 9 and the paper discharge tray 7. FIG. 4 is an oblique view of the printer 1 from diagonally above the printer back Y2 without the case 9 and the paper discharge tray 7. FIG. 5 is an oblique view of the carriage 45 from above the horizontal conveyance path portion 13*c* side when the carriage 45 is at the home position B. FIG. 6 is an oblique view of the area around the away position C from above the horizontal conveyance path portion 13*c* side.

As shown in FIG. 3 and FIG. 4, the carriage guide rail 46 and the carriage support rail 47 are supported by a first side frame 55, which extends up and on the longitudinal axis Y, at the ends on the first direction X1 on the transverse axis X.

The first side frame 55 is disposed with a specific gap to the horizontal conveyance path portion 13*c*.

The other ends of the carriage guide rail 46 and the carriage support rail 47 are supported by a second side frame 56, which is parallel to the first side frame 55, at the ends on the second direction X2 on the transverse axis X.

The second direction X2 is the opposite direction as the first direction X1.

The second side frame 56 is disposed with a specific gap to the horizontal conveyance path portion 13*c*.

The first side frame 55 and second side frame 56 support the carriage guide rail 46 and the carriage support rail 47 movably on the vertical axis Z. The first side frame 55 and second side frame 56 also support the carriage guide rail 46 and the carriage support rail 47 rotatably on their axes of rotation.

As shown in FIG. 3, the carriage drive mechanism 48 includes a pair of timing pulleys 48*a*, which are respectively disposed near the first side frame 55 and near the second side frame 56, and a timing belt 48*b* that is mounted on the pair of timing pulleys 48*a*. One part of the timing belt 48*b* is fastened to the carriage 45. By driving one of the timing pulleys 48*a* with the carriage motor 49, the carriage 45 moves along the carriage guide rail 46 and the carriage support rail 47.

As shown in FIG. 4, the carriage lift mechanism 52 includes eccentric cams 52*a*, cam support parts (not shown in the figure) that contacts the outside cam surfaces of the eccentric cams 52*a*, and a power transfer mechanism 52*b*. The eccentric cams 52*a* are attached to one end of both the carriage guide rail 46 and the carriage support rail 47. The power transfer mechanism 52*b* transfers the drive power of the lift motor 53 to the carriage guide rail 46 and the carriage support rail 47 and causes the rails to rotate on their axes of rotation.

A cam support part is disposed on both the first side frame 55 and the second side frame 56. When the lift motor 53 is driven by the control unit 54, the carriage guide rail 46 and the carriage support rail 47 turn synchronously. As a result, the eccentric cams 52*a* also turn, and rotation of the eccentric cam 52*a* causes the carriage guide rail 46 and the carriage support rail 47 to move up and down.

The home position B of the printhead 12 is between the horizontal conveyance path portion 13*c* and the first side frame 55. The maintenance mechanism 57 of the printhead 12 is disposed on the home position B. The maintenance mechanism 57 has a head cap 58 and a cap lift mechanism (not shown in the figure). The head cap 58 is disposed at a position opposite the nozzle face 12*a* of the printhead 12 when in the home position B. The cap lift mechanism moves the head cap 58 in the direction toward and the direction away from the printhead 12 at the home position B. The printhead 12 is set to the home position B by the carriage drive mechanism 48 at a regular predetermined time interval. When the printhead 12 is disposed at the home position B as shown in FIG. 4 and FIG. 5, the maintenance mechanism 57 performs a flushing operation that ejects ink droplets from the printhead 12 into the head cap 58. This flushing operation is a maintenance operation performed to resolve nozzle clogging caused by increased ink viscosity, for example. When the printer 1 is in the standby mode, the carriage drive mechanism 48 moves the printhead 12 to the home position B, resulting in the printhead 12 being covered by the head cap 58.

As shown in FIG. 3, FIG. 4, and FIG. 6, the away position C of the printhead 12 is between the horizontal conveyance path portion 13*c* and the second side frame 56. The away position C is a space to which part of the carriage 45 and the printhead 12 move outside of the horizontal conveyance path portion 13*c* when printing the end part of the second direction X2 of the printing paper P during the printing operation that prints to the printing paper P while the printhead 12 moves on the transverse axis X. By the carriage drive mechanism 48 moving the carriage 45, the printhead 12 can move bidirectionally in a line along the carriage guide rail 46 between the home position B and the away position C.

Carriage

Figure 7:
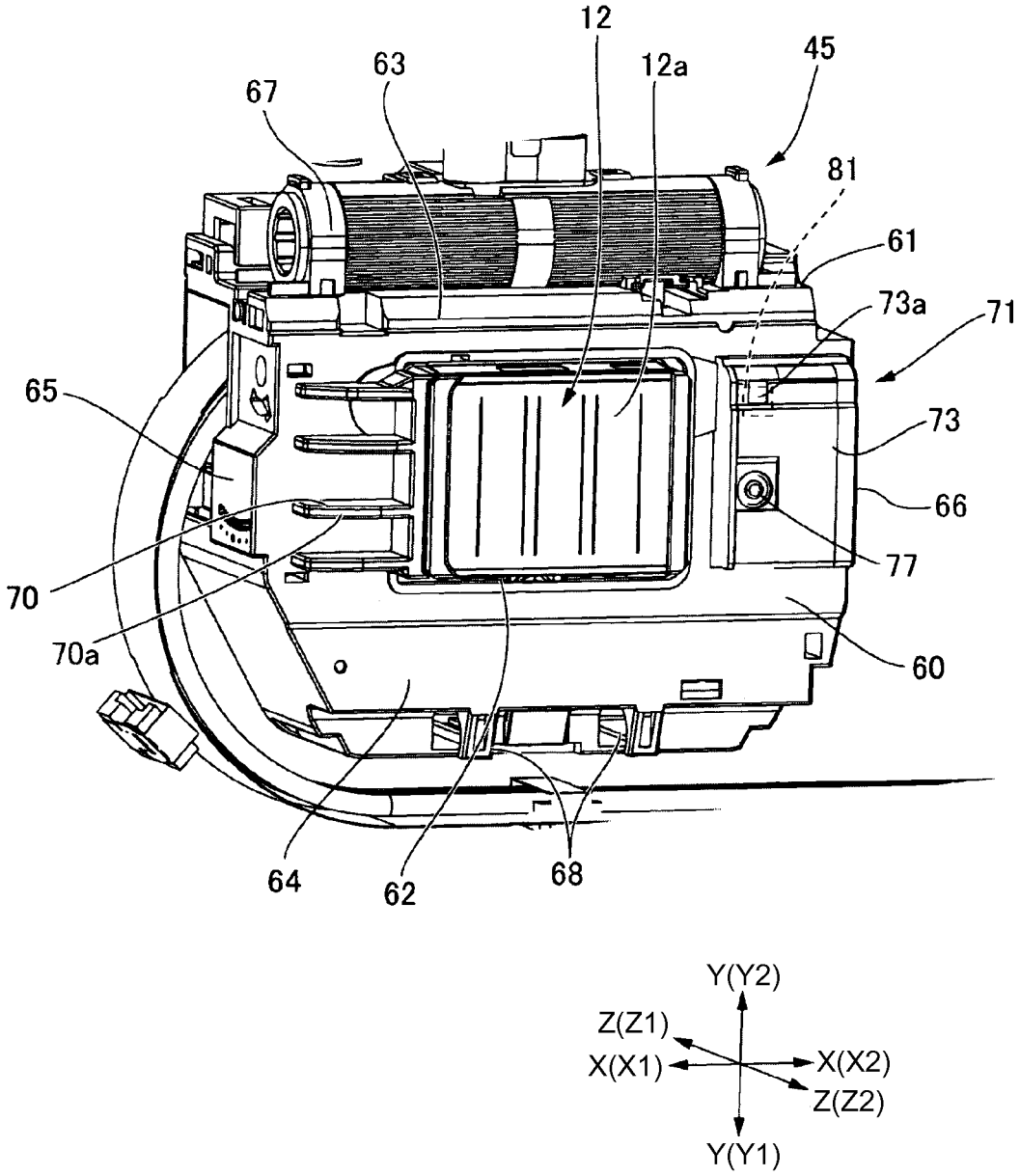
FIG. 7 is an oblique view from below of the carriage with the printhead mounted thereon in a first embodiment of the invention.
Figure 8A:
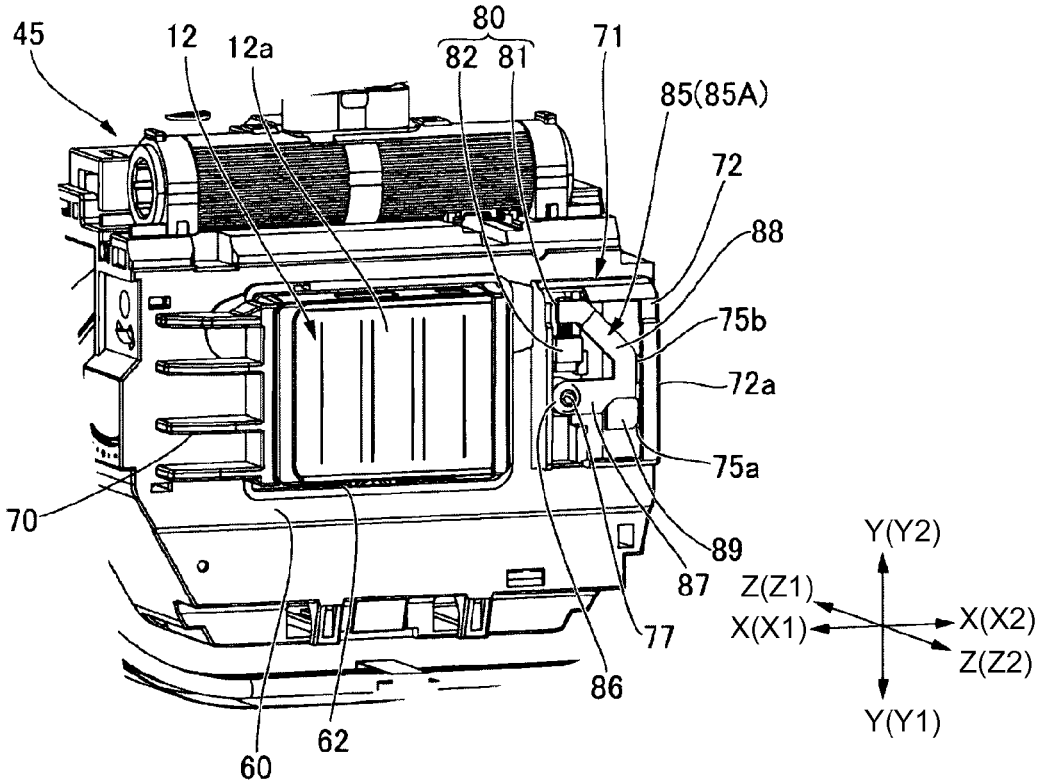
FIGS. 8A and 8B are oblique views from below of the carriage 45 with the paper detector cover removed in a first embodiment of the invention.
Figure 8B:
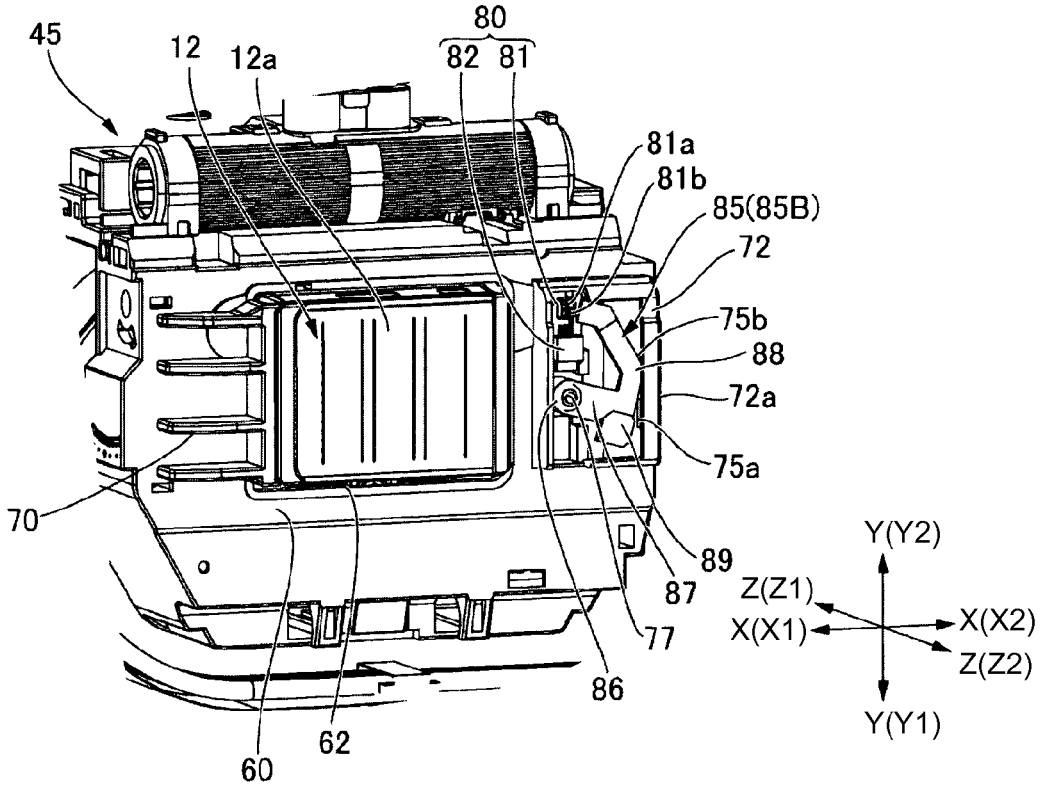
Figure 9:
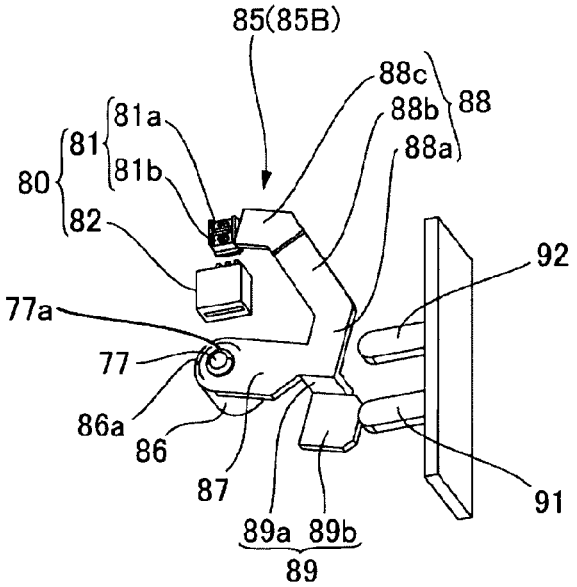
FIG. 9 illustrates the shutter and shutter operating member in a first embodiment of the invention.
Figure 9:
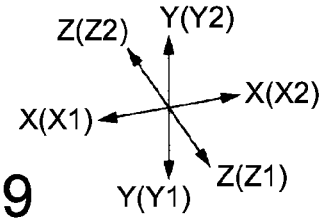

FIG. 7 is an oblique view from below the carriage 45 with the printhead 12 mounted thereon. FIGS. 8A and 8B are oblique views from below of the carriage 45 after the paper detector cover 73 has been removed. FIG. 8A shows the shutter 85 in the closed position 85A, and FIG. 8B shows the shutter 85 in the open position 85B. FIG. 9 shows the support pin 77, the paper detector 80, the shutter 85, a first shutter operating member 91, and a second shutter operating member 92.

As shown in FIG. 7, the carriage 45 has a bottom section 60, and a wall section 61 that rises up from the outside edge of the bottom section 60. The printhead 12 is inserted from above to the cavity formed by the bottom section 60 and the wall section 61. A rectangular opening 62 is formed in the bottom section 60. The long side of the opening 62 is aligned with the transverse axis X. The nozzle face 12*a* of the printhead 12 is exposed from the opening 62 to below.

The wall section 61 includes aback wall portion 63 located closer to the printer back Y2 than the opening 62, and a front wall portion 64 closer to the printer front Y1 than the opening 62. The wall section 61 also includes a first outside wall portion 65 and a second outside wall portion 66. The first outside wall portion 65 connects the back wall portion 63 to the front wall portion 64 in the first direction X1 (on the first side frame 55 side). The second outside wall portion 66 connects the back wall portion 63 and the front wall portion 64 in the second direction X2 (on the second side frame 56 side). A tubular section 67 is disposed substantially horizontally on the transverse axis X to the back wall portion 63. The carriage guide rail 46 is inserted in the tubular section 67. A slide 68 that can slide on the outside of the carriage support rail 47 is disposed on the front wall portion 64.

Four paper pressing ribs 70 that protrude down on the first direction X1 side of the opening 62 are formed on the bottom section 60 of the carriage 45. The four paper pressing ribs 70 are disposed with the same gap therebetween parallel to the transverse axis X. The bottom edges of the paper pressing ribs 70 are positioned below the nozzle face 12*a* of the printhead 12 exposed from the opening 62. An inclined guide surface 70*a* that slopes up toward the outside (in the first direction X1) is formed to each paper pressing rib 70 at the distal end thereof on the opposite side as the opening 62 on the transverse axis X.

A paper detector mount 71 is disposed on the bottom section 60 of the carriage 45 on the second direction X2 side of the opening 62. As shown in FIG. 7 and FIGS. 8A and 8B, the paper detector mount 71 includes a rectangular frame part 72 and the paper detector cover 73. The frame part 72 protrudes a specific height down from the bottom surface of the bottom section 60, and the paper detector cover 73 is disposed to cover the bottom opening of the frame part 72. The frame part 72 is disposed with the short sides aligned with the transverse axis X, and the long sides aligned with the longitudinal axis Y.

As shown in FIG. 5, two pairs of top and bottom slits are formed in line on the longitudinal axis Y to the frame part 72*a* extending on the longitudinal axis Y at the end of the frame part 72 in the second direction X2. More specifically, a pair of top slits 75*a*, 75*b*, and a pair of bottom slits 76*a*, 76*b* located below the top slits 75*a*, 75*b*, are disposed on the frame part 72*a*. The top slits 75*a*, 75*b* are disposed at the same height on the vertical axis Z. The bottom slits 76*a*, 76*b* are also disposed at the same height on the vertical axis Z. the slits 75*a*, 75*b*, 76*a*, 76*b* are all narrow slots whose length extends along the longitudinal axis Y.

As shown in FIG. 7, a rectangular detector opening 73*a* is formed in the paper detector cover 73. As shown in FIGS. 8A and 8B, the paper detector mount 71 includes a support pin 77. The support pin 77 is a round rod that protrudes down from the bottom surface of the bottom section 60 surrounded by the frame part 72.

The detector part 81 of the paper detector 80 (see FIG. 9) is disposed on the paper detector mount 71. The detector part 81 and the detector opening 73*a* are disposed at positions that overlap when the carriage 45 is seen from below on the vertical axis Z.

The paper detector 80 is an optical detector, and as shown in FIG. 9, includes a detector part 81 and a circuit part 82. The detector part 81 includes an emitter part 81*a* and a photodetector part 81*b*. The emitter part 81*a* emits a detection beam toward the print position A, and the photodetector part 81*b* senses the reflection of the detection beam from the printing paper P. The emitter part 81*a* and the photodetector part 81*b* of the detector part 81 are disposed with the emission surface and the photodetection surface thereof on the same plane facing the same direction. The circuit part 82 receives a command from the control unit 54, drives the emitter part 81*a* to emit the detection beam, amplifies and wave-shapes the output of the photodetector part 81*b*, and outputs to the control unit 54.

A shutter 85 that opens and closes the detector part 81 of the paper detector 80 is disposed on the paper detector mount 71. The shutter 85 is located between the detector part 81 and the detector opening 73*a*. The shutter 85 is supported by the support pin 77 movably between a closed position 85A where the shutter 85 covers the detector part 81 of the paper detector 80, and an open position 85B where the shutter 85 is open and the detector part 81 is uncovered. As shown in FIG. 8A, when the shutter 85 is in the closed position 85A, the detector opening 73*a* is covered by the shutter 85 (see FIG. 7). As shown in FIG. 8B, when the shutter 85 is in the open position 85B, the shutter 85 is moved to a position separated from the detector opening 73*a*. Therefore, when the carriage 45 is seen from below when the shutter 85 is in the open position 85B, the detector part 81 is exposed through the detector opening 73*a*.

As shown in FIG. 9, the shutter 85 includes the support pin 77, a tubular part 86, a protruding part 87, a first arm part 88, and a second arm part 89.

The support pin 77 is inserted to the tubular part 86, and the protruding part 87 protrudes straight to the outside radially from the tubular part 86. The first arm part 88 extends substantially horizontally to one side circumferentially from the distal end part of the protruding part 87, and the second arm part 89 protrudes in the other direction. The first arm part 88 has a first flat section 88*a* (first operating part), an inclined flat part 88*b*, and a shutter part 88*c*. The first flat section 88*a* (first operating part) extends in a direction perpendicular to the protruding part 87. The inclined flat part 88*b* bends from the distal end of the first flat section 88*a* to the inside toward the tubular part 86, and the shutter part 88*c* is formed at the distal end of the inclined flat part 88*b*. The shutter part 88*c* is the part that is disposed between the detector part 81 and the detector opening 73*a* when the shutter 85 is in the closed position 85A. The second arm part 89 includes a riser 89*a* that extends up from the protruding part 87, and a second flat section 89*b* (second operating part) that extends from the top end of the riser 89*a* substantially horizontally in the opposite direction as the first flat section 88*a*.

The shutter 85 is disposed on the paper detector mount 71 with the support pin 77 inserted into the tubular part 86. When thus disposed, the second flat section 89*b* of the second arm part 89 is positioned opposite the slit 75*a* at the printer front Y1 of the pair of top slits 75*a*, 75*b* (see FIG. 5) formed at the top of the frame part 72. Of the pair of bottom slits 76*a*, 76*b* (see FIG. 5) formed at the bottom of the frame part 72, the first flat section 88*a* of the first arm part 88 is positioned opposite the slit 76*b* closer to the back Y2 of the printer.

As shown in FIG. 6, a first shutter operating member 91 and a second shutter operating member 92 are disposed on the inside surface of the second side frame 56 near the away position C. The inside surface of the second side frame 56 is opposite the second outside wall portion 66 of the carriage 45 when the carriage 45 is in the away position C. The first shutter operating member 91 is closer to the printer front Y1 than the second shutter operating member 92. The first shutter operating member 91 and second shutter operating member 92 are identically shaped, are disposed at the same height on the vertical axis Z. The first shutter operating member 91 and second shutter operating member 92 are flat pieces that protrude in the first direction X1, and are inserted into the pair of top slits 75*a*, 75*b* or the pair of bottom slits 76*a*, 76*b* formed to the frame part 72 of the carriage 45.

The carriage drive mechanism 48 is driven by the control unit 54 controls driving the carriage motor 49. When printing, the carriage drive mechanism 48 moves the carriage 45 through the range of the printing paper P conveyed through the horizontal conveyance path portion 13*c*. At this time, the carriage drive mechanism 48 controls the carriage 45 to not move beyond the outside of the printing paper P on the transverse axis X. However, when opening and closing the shutter 85, the carriage drive mechanism 48 sets the carriage 45 to the away position C.

Figure 10:
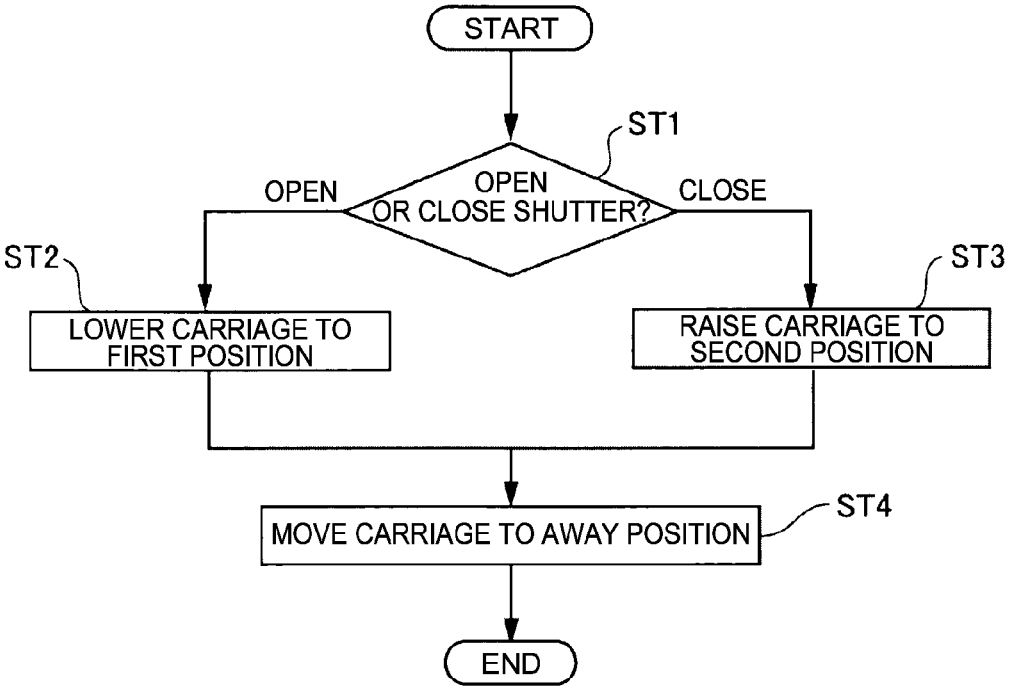
FIG. 10 is a flow chart of the open/close operation that opens and closes the shutter in a first embodiment of the invention.
Figure 11A:
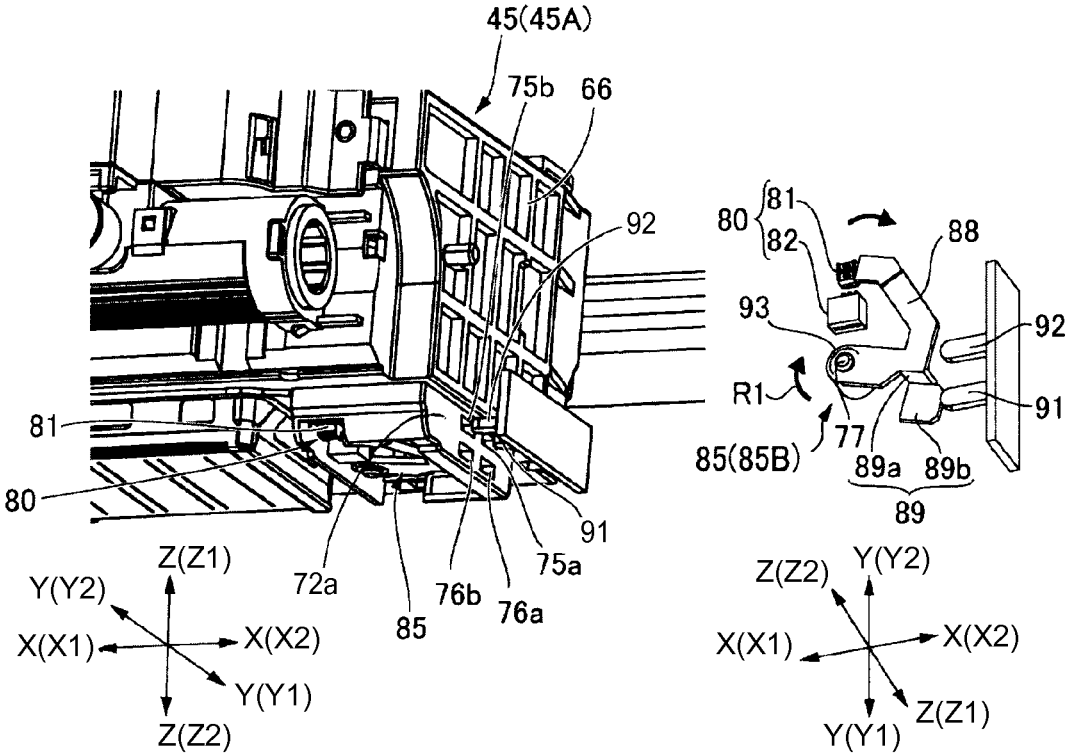
FIGS. 11A and 11B illustrate the open/close operation that opens and closes the shutter in a first embodiment of the invention.
Figure 11B:
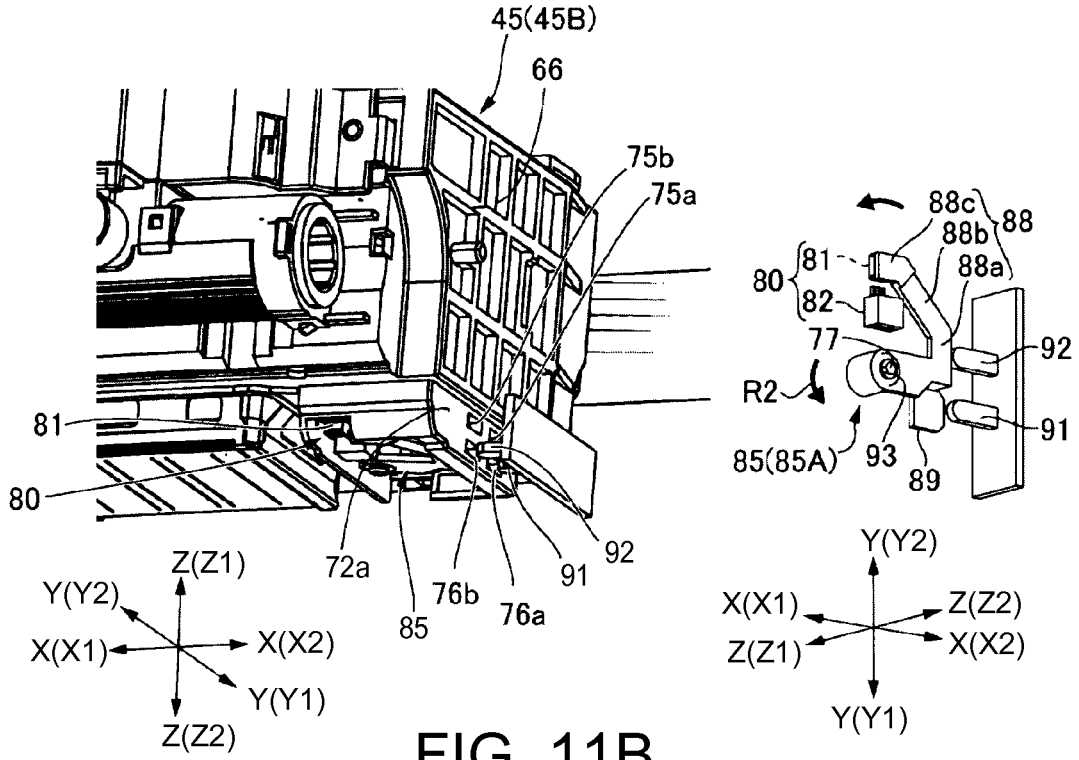

FIG. 10 is a flow chart of the operation that opens and closes the shutter 85. FIGS. 11A and 11B illustrate the opening and closing operation that opens and closes the shutter 85. The figure on the left in FIG. 11A shows the carriage 45 at the first position 45A just before reaching the away position C. As described above, the first position 45A is the position of the carriage 45 on the vertical axis Z set by the carriage lift mechanism 52 where the gap between the platen 51 and the printhead 12 is a first distance. The figure on the right in FIG. 11A illustrates when the first shutter operating member 91 operates the shutter 85.

The figure on the left in FIG. 11B shows just before the carriage 45 set to the second position 45B is moved to the away position C. The second position 45B is the position of the carriage 45 on the vertical axis Z where the gap between the platen 51 and the printhead 12 is a second distance, which is greater than the first distance. The figure on the right in FIG. 11B shows when the second shutter operating member 92 operates the shutter 85. In the printer 1 according to this embodiment, the shutter 85 is normally in the closed position 85A as shown in FIG. 7 and FIG. 8A.

When print data is supplied to the printer 1 from an external device, the control unit 54 executes a printing process based on the print data. Print data for executing a precision printing process that requires high positioning precision in the intended print area on the surface of the printing paper P is supplied in this embodiment of the invention. The print data for a precision printing process includes a paper position detection command, which commands the detection of the position of the leading end of the printing paper P in the first conveyance direction M1, and the positions of both edges of the printing paper P on the transverse axis X.

When the paper position detection command is received (step ST1 in FIG. 10), the control unit 54 opens the shutter 85. More specifically, the control unit 54 drives the lift motor 53 and moves the carriage 45 to the first position 45A (step ST2 in FIG. 10). Next, the control unit 54 drives the carriage motor 49 and moves the carriage 45 to the away position C (step ST4 in FIG. 10).

As shown in FIG. 11A, when the carriage 45 is set to the away position C, the first shutter operating member 91 and second shutter operating member 92 are inserted to the pair of top slits 75*a*, 75*b*. Before the carriage 45 completely reaches the away position C, the first shutter operating member 91 contacts the second flat section 89*b* of the second arm part 89 of the shutter 85. Next, as the carriage 45 moves to the away position C, the shutter 85 moves from the closed position 85A to the open position 85B. More specifically, after the first shutter operating member 91 contacts the shutter 85, when the carriage 45 moves to the away position C (moves in the second direction X2), the first shutter operating member 91 pushes the second arm part 89 of the shutter 85 in the first direction X1, and causes the shutter 85 to pivot on the support pin 77 in a first direction of rotation R1. When the carriage 45 then reaches the away position C, the shutter 85 is in the open position 85B.

When the shutter 85 moves from the closed position 85A to the open position 85B, the first shutter operating member 91 moves the shutter 85 in resistance to the friction that acts between the tubular part 86 of the shutter 85 and the support pin 77 of the carriage 45. After the shutter 85 is set to the open position 85B, the shutter 85 is held in the open position 85B by the friction that acts between the tubular part 86 of the shutter 85 and the support pin 77 of the carriage 45. More specifically, the inside surface 86*a* (the surface that slides against the carriage 45; see FIG. 9) of the tubular part 86 of the shutter 85, and the outside surface 77*a* (the surface that slides against the shutter 85; see FIG. 9) of the support pin 77 of the carriage 45, are friction surfaces that function as a position holding mechanism 93 that holds the position of the shutter 85.

The control unit 54 drives the carriage motor 49 and positions the carriage 45 over the horizontal conveyance path portion 13*c*. Next, the control unit 54 drives the paper feed motor 24 and the conveyance motor 36, and conveys the printing paper P from the paper cassette to the print position A.

When the printing paper P reaches the print position A, the paper detector 80 detects the leading end of the printing paper P. The control unit 54 can therefore know the position of the leading end of the printing paper P on the conveyance path 13 at the print position A. When the leading end of the printing paper P is detected, the control unit 54 drives the carriage motor 49 and moves the carriage 45 on the transverse axis X. As a result, the detector part 81 can detects both edges of the printing paper P on the transverse axis X. Therefore, the control unit 54 can also know the position of each edge of the printing paper P on the conveyance path 13 at the print position A.

When the control unit 54 knows the positions of both widthwise edges of the printing paper P, the control unit 54 executes the operation that returns the shutter 85 to the closed position 85A (step ST1 in FIG. 10). More specifically, the control unit 54 drives the lift motor 53 and moves the carriage 45 from the first position 45A to the second position 45B (step ST3 in FIG. 10). Next, the control unit 54 drives the carriage motor 49 and moves the carriage 45 to the away position C (step ST4 in FIG. 10).

As shown in FIG. 11 B, when the carriage 45 is set to the away position C, the first shutter operating member 91 and second shutter operating member 92 are first inserted to the pair of bottom slits 76*a*, 76*b*. Next, when the carriage 45 is completely set to the away position C, the second shutter operating member 92 contacts the first flat section 88*a* of the first arm part 88 of the shutter 85. Next, as the carriage 45 moves toward the away position C, the shutter 85 moves from the open position 85B to the closed position 85A. More specifically, after the second shutter operating member 92 contacts the shutter 85, and the carriage 45 then moves to the away position C (moves in the second direction X2), the second shutter operating member 92 pushes the first arm part 88 of the shutter 85 in the first direction X1, and causes the shutter 85 to pivot on the support pin 77 in the second direction of rotation R2. When the carriage 45 then reaches the away position C, the shutter 85 is in the closed position 85A.

When the shutter 85 moves from the open position 85B to the closed position 85A, the second shutter operating member 92 moves the shutter 85 in resistance to the friction acting between the tubular part 86 of the shutter 85 and the support pin 77 of the carriage 45. Therefore, after the shutter 85 is set to the closed position 85A, the shutter 85 is held in the closed position 85A by the friction acting between the tubular part 86 of the shutter 85 and the support pin 77 of the carriage 45. More specifically, the inside surface 86*a* (the surface that slides against the carriage 45) of the tubular part 86 of the shutter 85, and the outside surface 77*a* (the surface that slides against the shutter 85) of the support pin 77 of the carriage 45, are friction surfaces that function as a position holding mechanism 93 that holds the position of the shutter 85.

The printing process is then executed based on the print data. The control unit 54 drives the carriage motor 49 and positions the carriage 45 over the horizontal conveyance path portion 13*c*. Next, the control unit 54 controls driving of the lift motor 53 and moving of the carriage 45 up and down based on the paper type of the printing paper P contained in the print data, and sets the gap between the printhead 12 and the platen 51 to the first distance or the second distance. Next, the control unit 54 drives the printhead 12, the carriage motor 49, and the conveyance motor 36 to execute the printing process on the first side of the printing paper P passing the print position A. The printing process is executed based on the position of the printing paper P on the conveyance path 13 detected precisely by the paper detector 80. More specifically, the printing operation that ejects ink droplets onto the printing paper P while moving the printhead 12 on the transverse axis X, and the conveyance operation that incrementally advances the printing paper P a specific distance, are executed alternately. When the printing process ends, the control unit 54 continues driving the conveyance motor 36 to discharge the printing paper P from the paper exit 8.

Effect of Operation

A printer 1 according to the first embodiment of the invention has a shutter 85 that covers the detector part 81 of a paper detector 80 mounted on the carriage 45. By covering the detector part 81 with the shutter 85, ink mist is prevented from sticking to the detector part 81 even when some of the ink droplets ejected from the printhead 12 become airborne ink mist inside the case 9 before the ink droplets reach the printing paper P. A separate configuration for capturing the ink mist is therefore not needed in the printer 1 to suppress ink mist from sticking to the detector part 81 of the paper detector 80. In addition, the shutter 85 mounted on the carriage 45 is moved by contact with the first shutter operating member 91 and second shutter operating member 92, and opens and closes the detector part 81. The mechanism for opening and closing the shutter 85 can therefore be simplified, and a separate, new drive source for opening and closing the shutter 85 is not required.

In the first embodiment of the invention, the control unit 54 can open and close the shutter 85 by first setting the carriage 45 to the first position 45A or the second position 45B, and then moving the carriage 45 to the away position C. As a result, the shutter 85 can be moved between the open position 85B and the closed position 85A without disposing the first shutter operating member 91 and second shutter operating member 92 used for opening and closing the shutter 85 on both sides of the range of carriage 45 movement on the transverse axis X.

Furthermore, because the shutter 85 is opened and closed by movement of the carriage 45 in this embodiment of the invention, a drive mechanism such as a dedicated actuator for opening and closing the shutter 85 is not required. In addition, The shutter 85 is held in the closed position 85A or the open position 85B by the friction that works between the tubular part 86 of the shutter 85 and the support pin 77 of the carriage 45. As a result, providing a special position holding mechanism 93 for holding the position of the shutter 85 is not required.

Variation 1

The embodiment described above holds the position of the shutter 85 by means of the friction of the position holding mechanism 93 between the inside surface 86*a* of the tubular part 86 of the shutter 85 and the outside surface 77*a* of the support pin 77 of the carriage 45. However, the position holding mechanism 93 is not so limited. For example, the position holding mechanism 93 may be a detent mechanism having a protruding part disposed on the carriage 45 or the shutter 85, and a catch disposed on the other of the carriage 45 and shutter 85 to catch the protruding part. In this event, the detent mechanism can be configured between the shutter 85 and the bottom section 60 of the carriage 45, or between the shutter 85 and the paper detector cover 73.

Variation 2

In the foregoing embodiment the carriage lift mechanism 52 raises and lowers the carriage 45 by raising or lowering the carriage guide rail 46 and the carriage support rail 47. However, a configuration that raises and lowers a carriage 45 on a carriage guide rail 46 and carriage support rail 47 at a fixed position could be used instead.

Variation 3

By changing the shape of the shutter 85 from that described in the foregoing embodiment, the control unit 54 may be configured to move the shutter 85 from the open position 85B to the closed position 85A when the carriage 45 is moved from the first position 45A to the away position C. In this event, the control unit 54 may be configured to move the shutter 85 from the closed position 85A to the open position 85B when the carriage 45 is moved from the second position 45B to the away position C.

Embodiment 2

A printer 1 according to another embodiment of the invention is described next with reference to FIG. 1 to FIG. 4 and FIG. 12 to FIG. 17.

Figure 12:
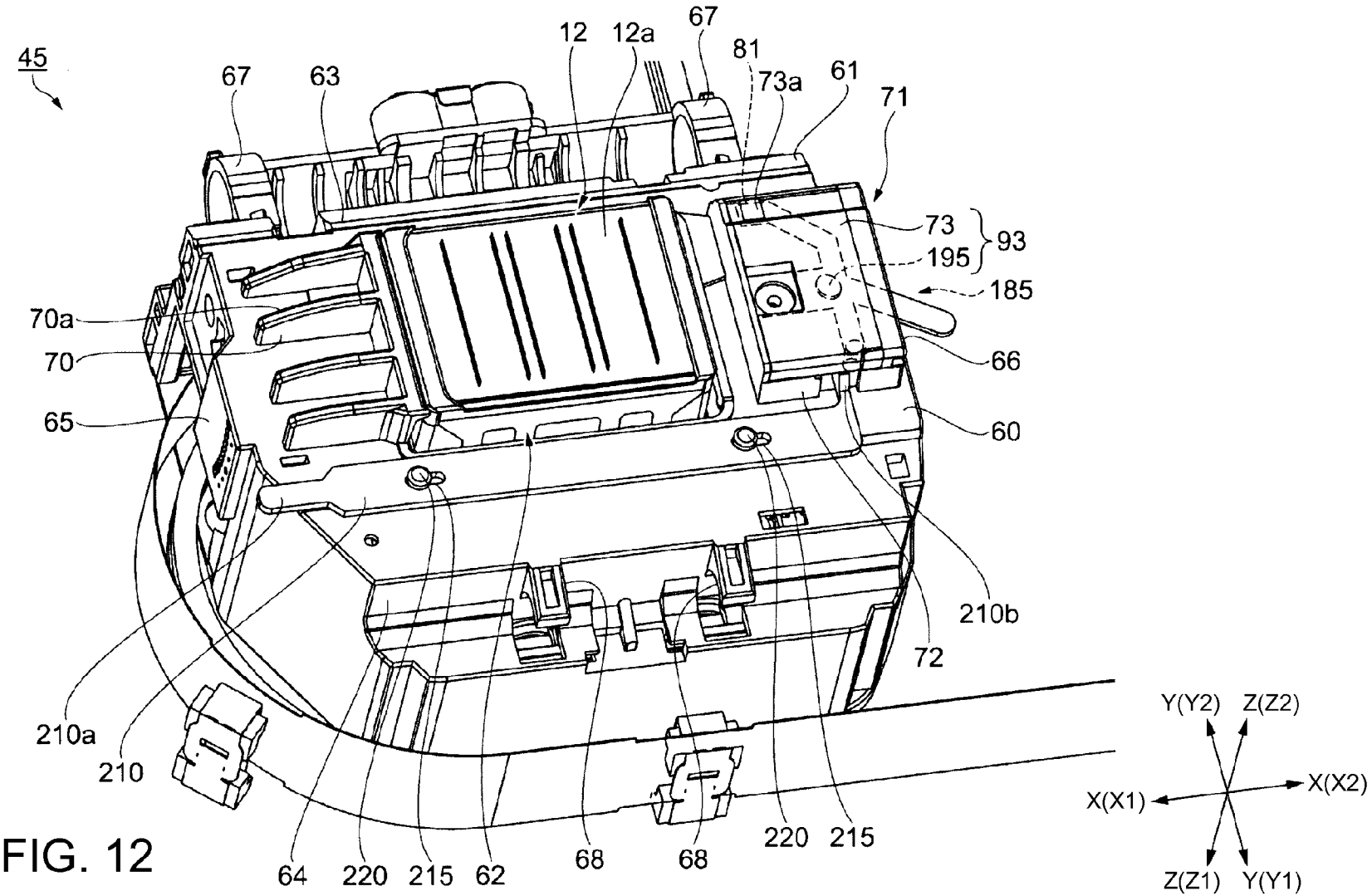
FIG. 12 is an oblique view from below of the carriage with the printhead mounted thereon in a second embodiment of the invention.

FIG. 12 is an oblique view from below the carriage with the printhead 12 mounted thereon in a second embodiment of the invention.

Figure 13A:
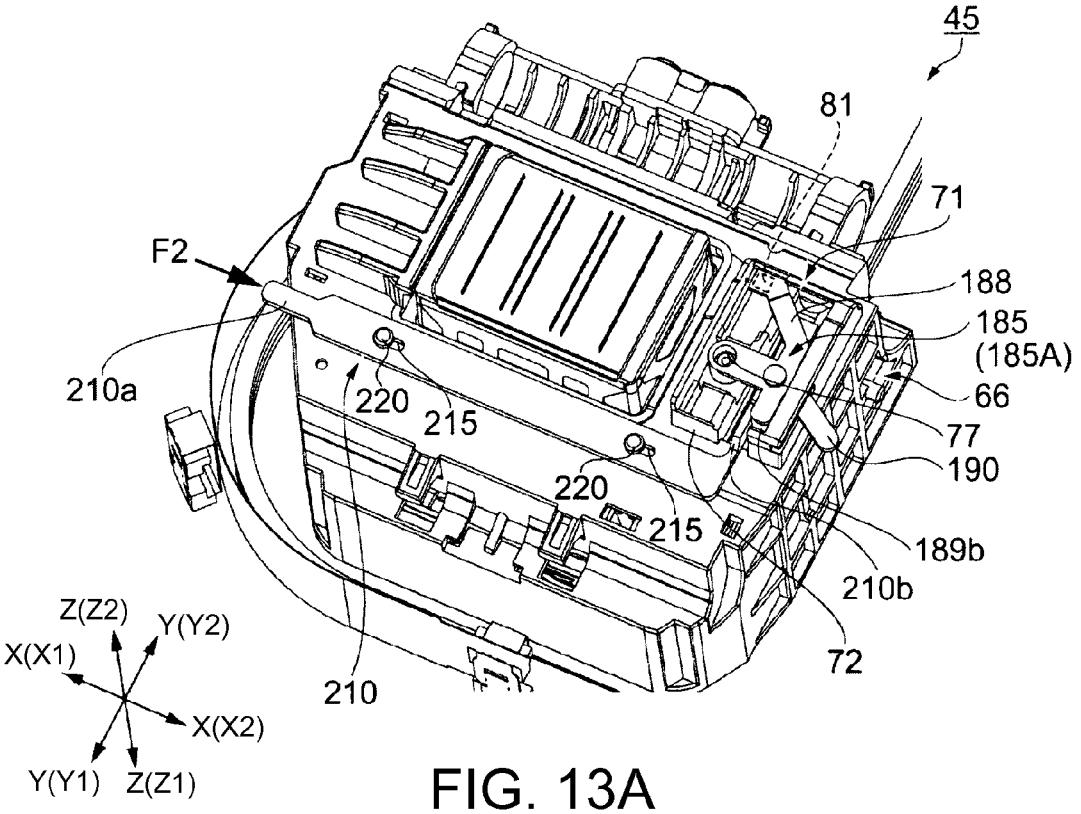
FIGS. 13A and 13B are oblique views from below of the carriage 45 with the paper detector cover removed in a second embodiment of the invention.
Figure 13B:
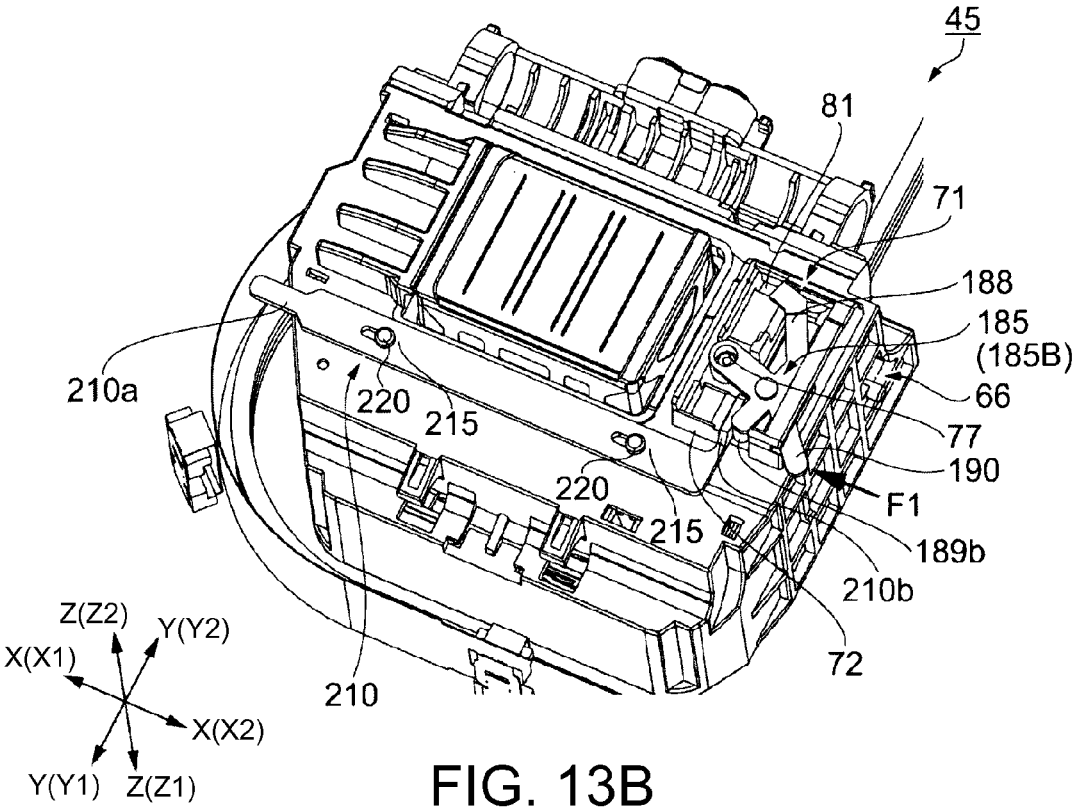

FIGS. 13A and 13B are oblique views from below the carriage 45 with the paper detector cover 73 removed. FIG. 13A shows when the shutter 185 is in the closed position 185A, and FIG. 13B shows when the shutter 185 is in the open position 185B.

Figure 14:
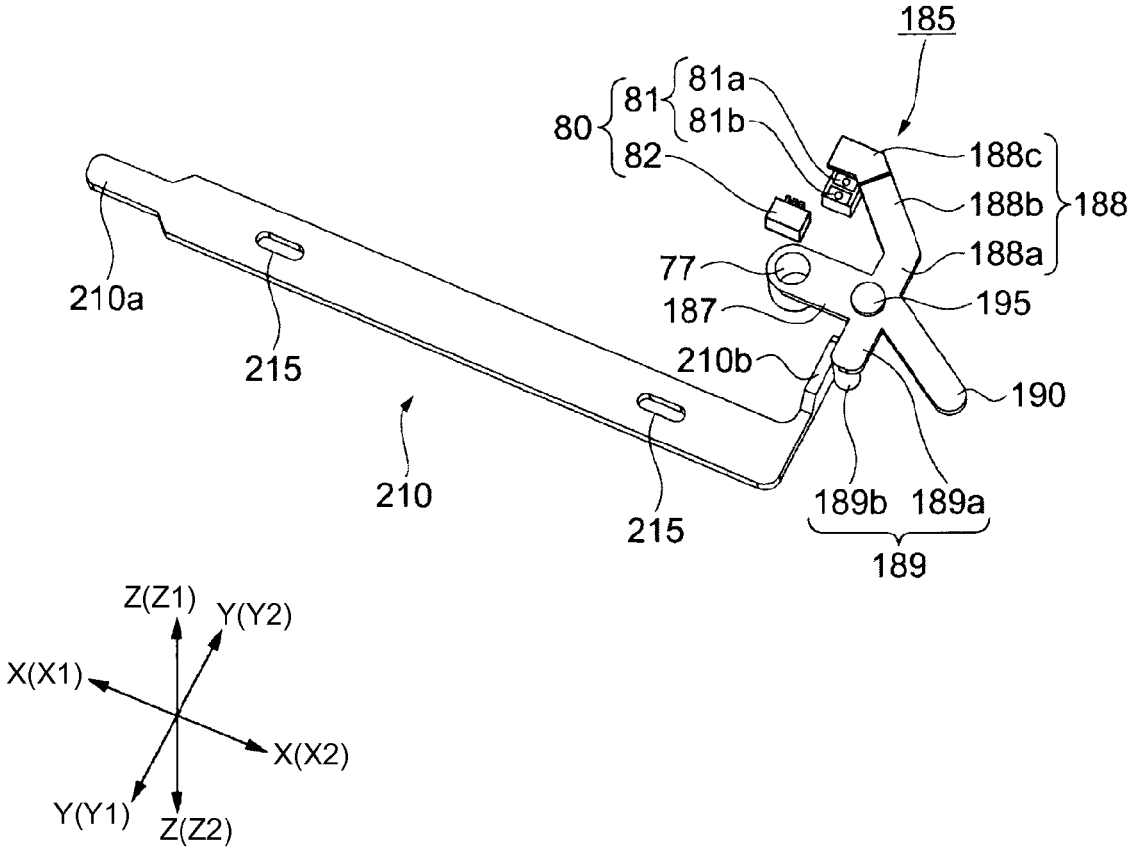
FIG. 14 illustrates the shutter and shutter operating member in a second embodiment of the invention.
Figure 15:
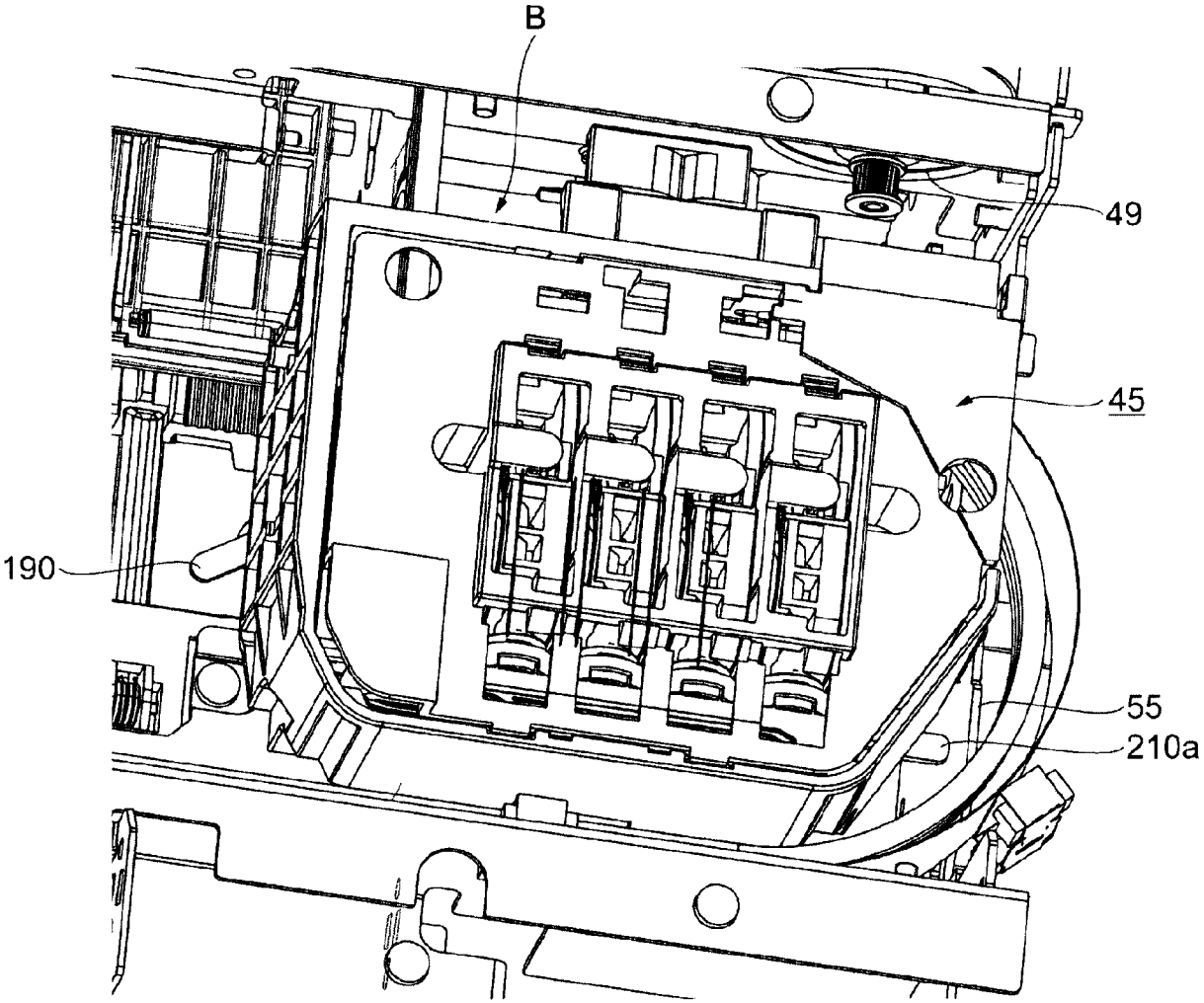
FIG. 15 is an oblique view from above of the carriage when moved to the home position in a second embodiment of the invention.
Figure 15:
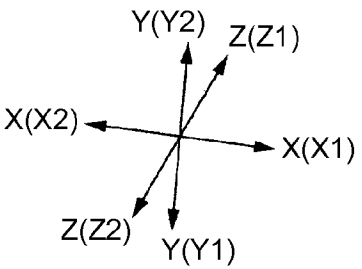
Figure 16:
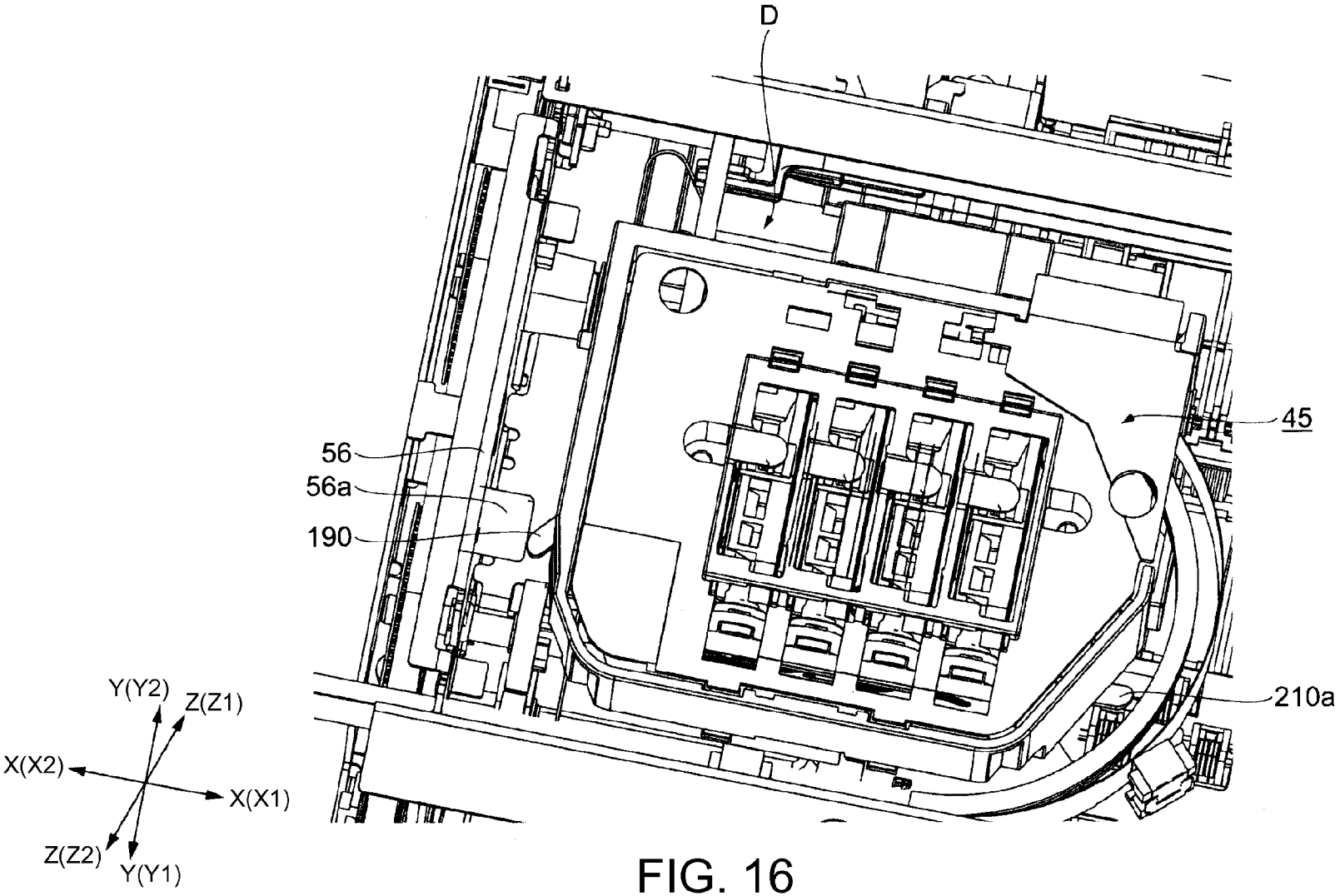
FIG. 16 is an oblique view from above of the carriage when moved to the shutter open position in a second embodiment of the invention.

FIG. 14 illustrates the shutter 185 and shutter operating member 210. FIG. 15 is an oblique view from above of the carriage 45 when in the home position B. FIG. 16 is an oblique view from above of the carriage 45 when in the open shutter position D (described below).

Figure 17:
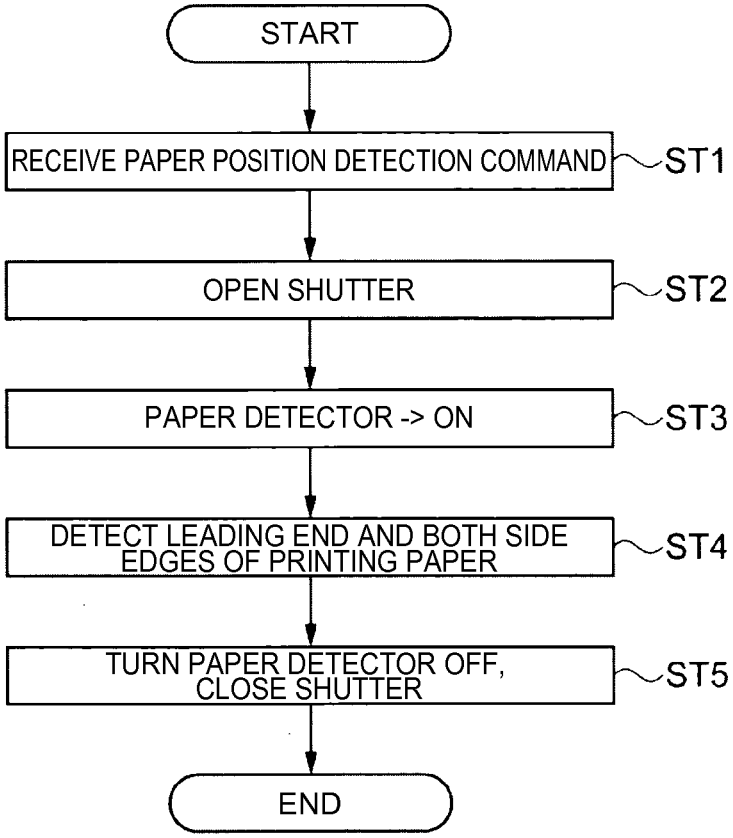
FIG. 17 is a flow chart of the shutter open/close operation and the paper position detection operation.

FIG. 17 is a flow chart of the shutter opening/closing operation, and the paper position detection operation.

Note that like configurations and content in this and the first embodiment are identified by the same reference numerals in FIG. 12 to FIG. 17, and further description thereof is omitted.

As shown in FIG. 3 and FIG. 4, there is an open shutter position D between the away position C and the second side frame 56. While described in further detail below, the open shutter position D is the position for moving the shutter 185 (see FIG. 12 to FIG. 14) disposed on the carriage 45 from the closed position 185A to the open position 185B. After being set to the away position C by driving the carriage drive mechanism 48 (see FIG. 2), the carriage 45 is set to the open shutter position D by driving the carriage drive mechanism 48 further.

As shown in FIG. 12 and FIGS. 13A and 13B, the shutter 185 that opens and closes the detector part 81 of the paper detector 80 is disposed on the paper detector mount 71. The shutter 185 is located between the detector part 81 and the detector opening 73*a*. The shutter 185 is supported on the support pin 77 movably between the closed position 185A where the shutter 185 covers the detector part 81 of the paper detector 80, and the open position 185B where the detector part 81 is open (not covered). As shown in FIG. 13A, when the shutter 185 is in the closed position 185A, the detector opening 73*a* is closed from above by the shutter 185 (see FIG. 12). As shown in FIG. 13B, when the shutter 185 is in the open position 185B, the shutter 185 is in a position removed from the detector opening 73*a*. Therefore, when the carriage 45 is seen from below when the shutter 185 is in the open position 185B, the detector part 81 is visible (is exposed) through the detector opening 73*a*.

As shown in FIG. 14, the shutter 185 has a protruding part 187, a first arm part 188, a second arm part 189, and a third arm part 190. The protruding part 187 protrudes straight to the outside radially from the support pin 77, and the first arm part 188, the second arm part 189, and the third arm part 190 extend from the end of the protruding part 187.

The first arm part 188 has a first flat section 188*a* that extends substantially horizontally to one side circumferentially to the support pin 77, an inclined flat part 188*b* that extends from the distal end of the first flat section 188*a* and extends to the inside toward the support pin 77, and a shutter part 188*c* disposed at the distal end of the inclined flat part 188*b*. The shutter part 188*c* is the part that intercedes between the detector part 81 and the detector opening 73*a* when the shutter 185 is in the closed position 185A.

The second arm part 189 has a second flat section 189*a* that extends substantially horizontally to the opposite side as the first arm part 188, and a columnar part 189*b* that extends in the axial direction of the support pin 77 from the end of the second flat section 189*a*. The columnar part 189*b* is the part that slides in contact with the shutter operating member 210 described below.

The third arm part 190 is a diagonal member that extends substantially horizontally to the outside radially to the support pin 77 from the junction of the first arm part 188 and the second arm part 189, and extends at an angle from the first arm part 188 side toward the second arm part 189 side. In this second embodiment of the invention, the third arm part 190 functions as a third shutter operating member.

The shutter operating member 210 is a flat rectangular member that functions as a fourth shutter operating member. The shutter operating member 210 includes a first contact part 210*a* that extends lengthwise from one lengthwise end of the shutter operating member 210, and a second contact part 210*b* at the other end. The second contact part 210*b* protrudes from the end of the shutter operating member 210 perpendicularly to the long axis, and is thicker than the flat part of the shutter operating member 210. The second contact part 210*b* is the part that slides against the columnar part 189*b* of the shutter 185. The shutter operating member 210 has two oval holes 215 formed with the long axes parallel to the length of the shutter operating member 210, and is disposed on the carriage 45 and enabled to move in the same direction as the bidirectional movement of the carriage 45 by a positioning pin 220 passing through each of the oval holes 215 (see FIG. 12, and FIGS. 13A and 13B).

FIG. 13A illustrates the shutter 185 in the closed position 185A. When the first contact part 210*a* is pushed in the second direction X2 on the transverse axis X by force in the direction of arrow F2, the shutter operating member 210 moves in the second direction X2 within the range allowed by the oval holes 215 and positioning pins 220. As a result, the columnar part 189*b* of the shutter 185 is pushed by the second contact part 210*b* of the shutter operating member 210, and the shutter 185 moves to the closed position 185A.

FIG. 13B illustrates the shutter 185 in the open position 185B. When the third arm part 190 functioning as a third shutter operating member is pushed by force in the direction of arrow F1 and moves in the first direction X1 on the transverse axis X, the shutter 185 pivots on the support pin 77 toward the printer front Y1 on the longitudinal axis Y. As a result, the second contact part 210*b* is pushed sliding against the columnar part 189*b* formed in unison with the third arm part 190, and the shutter operating member 210 therefore moves in the first direction X1 on the transverse axis X in the range allowed by the oval holes 215 and the positioning pins 220.

FIG. 15 is an oblique view from above of the carriage 45 when in the home position B. In the home position B, the first contact part 210*a* of the shutter operating member 210 contacts the first side frame 55 of the printer 1, the first side frame 55 being a stationary member that opposes the carriage. As a result, when the carriage 45 moves in the first direction X1, the first contact part 210*a* is pushed by the first side frame 55, and the shutter operating member 210 moves in the second direction X2 (see FIG. 13A).

FIG. 16 is an oblique view from above of the carriage 45 when in the open shutter position D. In the open shutter position D, the third arm part 190 of the shutter 185 contacts a protruding part 56*a* of the second side frame 56 of the printer 1, which is another stationary member that opposes the carriage. Therefore, when the carriage 45 moves in the second direction X2, the third arm part 190 is pushed by the protruding part 56*a* of the second side frame 56, and the shutter 185 pivots toward the printer front Y1. At this time, the shutter operating member 210 is pushed by the columnar part 189*b* and moves in the first direction X1 (see FIG. 13B).

FIG. 17 is a flow chart of the opening and closing operation of the shutter 185 and the paper position detection operation.

When print data is supplied to the printer 1 from an external device (a host device not shown), the control unit 54 executes a printing process based on the print data. Print data for executing a precision printing process that requires high positioning precision in the intended print area on the surface of the printing paper P is supplied in this embodiment of the invention. The operation that opens and closes the shutter 185, and the paper position detection operation, are sequentially described below based on FIG. 17.

Step ST1: The print data for a precision printing process includes a paper position detection command, which commands the detection of the position of the leading end of the printing paper P in the first conveyance direction M1, and the positions of both edges of the printing paper P on the transverse axis X. The control unit 54 therefore receives a paper position detection command together with the print data.

Step ST2: When the paper position detection command is received, the control unit 54 drives the carriage moving mechanism 50 to move the carriage 45 to the open shutter position D. When the carriage 45 moves to the open shutter position D, the third arm part 190 of the shutter 185 contacts and is pushed by the protruding part 56*a* of the second side frame 56 of the printer 1 (see FIG. 16). As a result, the shutter 185 pivots on the support pin 77 to the printer front Y1 (see FIG. 13B). As a result, the shutter part 188*c* of the shutter 185 covering the detector part 81 of the paper detector 80 moves to the open position 185B, and the detector part 81 is opened (uncovered). The shutter operating member 210 is pushed by the columnar part 189*b* at this time and moves in the first direction X1.

As shown in FIG. 12, a slide pin 195 disposed on the first arm part 188, and the inside surface of the paper detector cover 73, slide against each other. Therefore, when the shutter 185 is moved from the closed position 185A to the open position 185B, the shutter 185 moves in resistance to the friction that works between the slide pin 195 and the inside surface of the paper detector cover 73. As a result, after the shutter 185 is moved to the open position 185B, the shutter 185 is held in the open position 185B by the friction that acts between the slide pin 195 and the inside surface of the paper detector cover 73. More specifically, the top of the slide pin 195 and the inside surface of the paper detector cover 73 are friction surfaces, and function as a position holding mechanism 93 that holds the shutter 185 in position.

Step ST3: After the shutter 185 that covered the paper detector 80 is opened in step ST2, the control unit 54 drives the carriage motor 49 to position the carriage 45 over the horizontal conveyance path portion 13*c*, and turns the paper detector 80 on (detection enabled state). More specifically, the control unit 54 enables the emitting of a detection beam from the emitter part 81*a* to the printing paper P, and detecting the detection beam by the photodetector part 81*b*.

Step ST4: The control unit 54 drives the paper feed motor 24 and the conveyance motor 36, and conveys the printing paper P from the paper cassette to the print position A. Because the printing paper P reflects the detection beam emitted from the emitter part 81*a* when the printing paper P reaches the print position A, the photodetector part 81*b* can detect the reflected light. Therefore, because whether or not printing paper P is present is detected based on whether or not the photodetector part 81*b* detects the detection beam, the leading end of the printing paper P can be detected. The circuit part 82 amplifies and wave-shapes the output of the photodetector part 81*b*, and outputs it to the control unit 54. As a result, the control unit 54 knows that the leading end of the printing paper P on the conveyance path 13 is at the print position A.

When the leading end of the printing paper P is detected, the control unit 54 drives the photodetector part 81*b* to detect the detection beam while driving the carriage motor 49 to move the carriage 45 on the transverse axis X. As a result, because the detector part 81 can detect the printing paper P on the transverse axis X, the control unit 54 can also know the positions of both widthwise edges of the printing paper P on the conveyance path 13 at the print position A.

Step ST5: The control unit 54 then turns the paper detector 80 off (disables detection) again, and drives the carriage moving mechanism 50 to move the carriage 45 to the home position B. When the carriage 45 moves to the home position B, the first contact part 210*a* of the shutter operating member 210 contacts and is pushed by the first side frame 55 of the printer 1 (see FIG. 15). In conjunction therewith, the second contact part 210*b* of the shutter operating member 210 slides against the columnar part 189*b* of the shutter 185, and causes the shutter 185 to pivot to the printer back Y2 on the support pin 77. As a result, the shutter 185 is set to the closed position 185A and covers the detector part 81 of the paper detector 80 (see FIG. 13A).

When the shutter 185 moves from the open position 185B to the closed position 185A, the shutter 185 moves in resistance to the friction that acts between the slide pin 195 disposed on the first arm part 188 and the inside surface of the paper detector cover 73 in the same way as when moving from the closed position 185A to the open position 185B. Therefore, after the shutter 185 reaches the closed position 185A, the shutter 185 is held in the closed position 185A by the friction that works between the slide pin 195 and the inside surface of the paper detector cover 73.

As described above, based on a command from a host device, the control unit 54 moves the carriage 45 to the open shutter position D, opens the shutter 185, and then detects the edges of the printing paper P with the paper detector 80. After paper edge detection is completed, the control unit 54 moves the carriage 45 to the home position B, closes the shutter 185, and covers the detector part 81 of the paper detector 80. More specifically, the edges of the printing paper P are detected when the shutter 185 is open and the detector part 81 of the paper detector 80 is open (not covered).

The printing process is then executed based on the print data in the same way as described in the first embodiment above.

The printer 1 according to the second embodiment of the invention has a shutter 185 that covers the detector part 81 of the paper detector 80 mounted on a carriage 45. By covering the detector part 81 with a shutter 185, ink mist is prevented from sticking to the detector part 81 even when some of the ink droplets ejected from the printhead 12 become airborne ink mist inside the case 9 before the ink droplets reach the printing paper P. A separate configuration such as a fan and filter for capturing the ink mist is therefore not needed in the printer 1 to suppress ink mist from sticking to the detector part 81 of the paper detector 80. Because space to accommodate such a configuration is also not needed, device size can be reduced and an increase in production cost can be suppressed.

In this second embodiment of the invention the shutter 185 is also held in the closed position 185A or the open position 185B by the friction that works between the slide pin 195 of the shutter 185 and the inside surface of the paper detector cover 73. A simply configured position holding mechanism 93 for the shutter 185 can therefore be provided.

Variation 4

The paper position detection command is included in the print data sent to the control unit 54 in the foregoing second embodiment of the invention, but the paper position detection command may be sent to the control unit 54 separately from the print data at a desired timing from an external device (a host device not shown).

Variation 5

The slide pin 195 that together with the inside surface of the paper detector cover 73 embodies the position holding mechanism 93 may be disposed on the protruding part 187. The slide pin 195 may also be disposed on a surface (a surface on the opposite side as the surface opposing the paper detector cover 73) of the first arm part 188 or the protruding part 187 opposing the carriage 45. In this configuration, the slide pin 195 slides against the carriage 45, and the shutter 185 is held in the open position 185B by the friction working between the slide pin 195 and the carriage 45. A configuration in which the first arm part 188 or the protruding part 187 slides against the inside surface of the paper detector cover 73 or the carriage 45 without using a slide pin 195 is also conceivable.

Variation 6

Further alternatively, the position holding mechanism 93 may be a detent mechanism having a protruding part disposed on the carriage 45 or the shutter 185, and a catch disposed on the other of the carriage 45 and shutter 185 to catch the protruding part. In this event, the detent mechanism can be configured between the shutter 185 and the bottom section 60 of the carriage 45, or between the shutter 185 and the paper detector cover 73.

Variation 7

The shutter operating member 210 is not limited to a flat, rectangular member, and may be a round or square rod member, or a combination of a flat member and a rod member.

Variation 8

Figure 18:
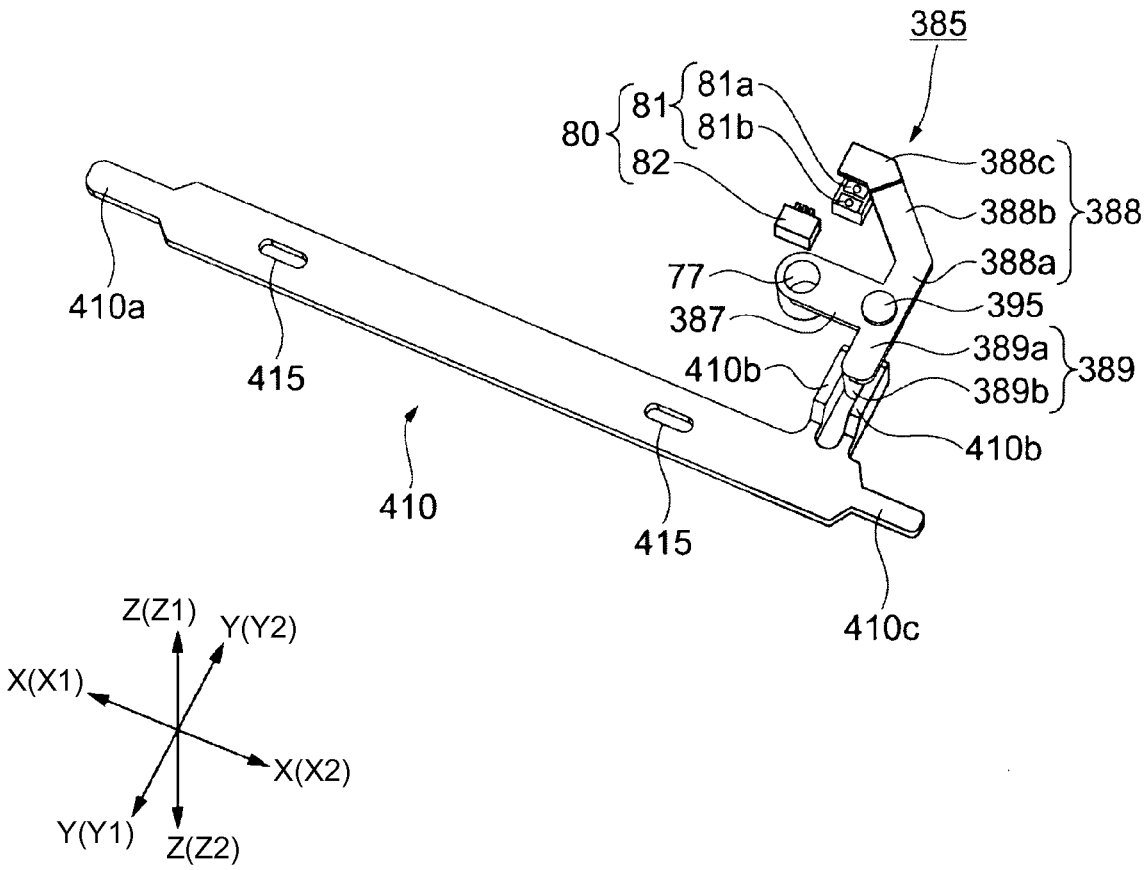
FIG. 18 illustrates a variation of the shutter and shutter operating member according to a second embodiment of the invention.

FIG. 18 illustrates another variation (variation 8) of the shutter 185 and the shutter operating member 210. A shutter 385 and a shutter operating member 410 according to this eighth variation of the invention are described below with reference to FIG. 18.

Note that like configurations and content in this and the first embodiment are identified by the same reference numerals in FIG. 18, and further description thereof is omitted.

As shown in FIG. 18, the shutter 385 is substantially the same as the configuration of the shutter 185 in the second embodiment of the invention (FIG. 14) except that a part corresponding to the third arm part 190 used as a third shutter operating member is omitted. Therefore, the parts of the shutter 385 identified by reference numerals 387, 388, 388*a*, 388*b*, 388*c*, 389, 389*a*, 389*b*, 395 are the same as the parts of the shutter 185 identified by reference numerals 187, 188, 188*a*, 188*b*, 188*c*, 189, 189*a*, 189*b*, 195.

The shutter operating member 410 is identical to the configuration of the shutter operating member 210 (FIG. 14) described in the second embodiment in that it is a flat rectangular member, having a first contact part 410*a* extending lengthwise, and having two oval holes 415. In addition, the shutter operating member 410 has two second contact parts 410*b* protruding perpendicularly to the lengthwise direction, and a third contact part 410*c*. The second contact parts 410*b* are mutually parallel, and are thicker than the thickness of each of the first contact part 410*a* and the third contact part 410*c*. The two second contact parts 410*b* slide in contact with the columnar part 389*b* of the shutter 385 held therebetween. The third contact part 410*c* functions in this embodiment of the invention as a third shutter operating member. Therefore, the shutter operating member 410 in this variation of the invention is a common operating member in which the third shutter operating member and the fourth shutter operating member are combined as one element.

When the carriage 45 is moved to the open shutter position D, the third contact part 410*c* of the shutter operating member 410 contacts the second side frame 56 of the printer 1, causing the shutter operating member 410 to move in the first direction X1. Because the two second contact parts 410*b* of the shutter operating member 410 slide with the columnar part 389*b* of the shutter 385 held therebetween, the shutter 385 pivots around the support pin 77. As the result, the shutter part 388*c* of the shutter 385 covering the detector part 81 of the paper detector 80 moves in the second direction X2, and the detector part 81 is opened (uncovered).

When the carriage 45 moves to the home position B, the first contact part 410*a* of the shutter operating member 410 contacts the first side frame 55 of the printer 1, and the shutter operating member 410 therefore moves in the second direction X2. The shutter 385 of the shutter operating member 410 therefore pivots around the support pin 77, the shutter part 388*c* moves in the first direction X1 and covers the detector part 81 of the paper detector 80, and the detector part 81 is closed.

Variation 9

Variation 4 to variation 7 described above can also be applied to a printer 1 employing the shutter operating member 410 and the shutter 385 of variation 8 described above.

Embodiment 3

Another embodiment of a printer 1 according to the invention is described below with reference to FIG. 1 to FIG. 4 and FIG. 19 to FIG. 22.

Figure 19:
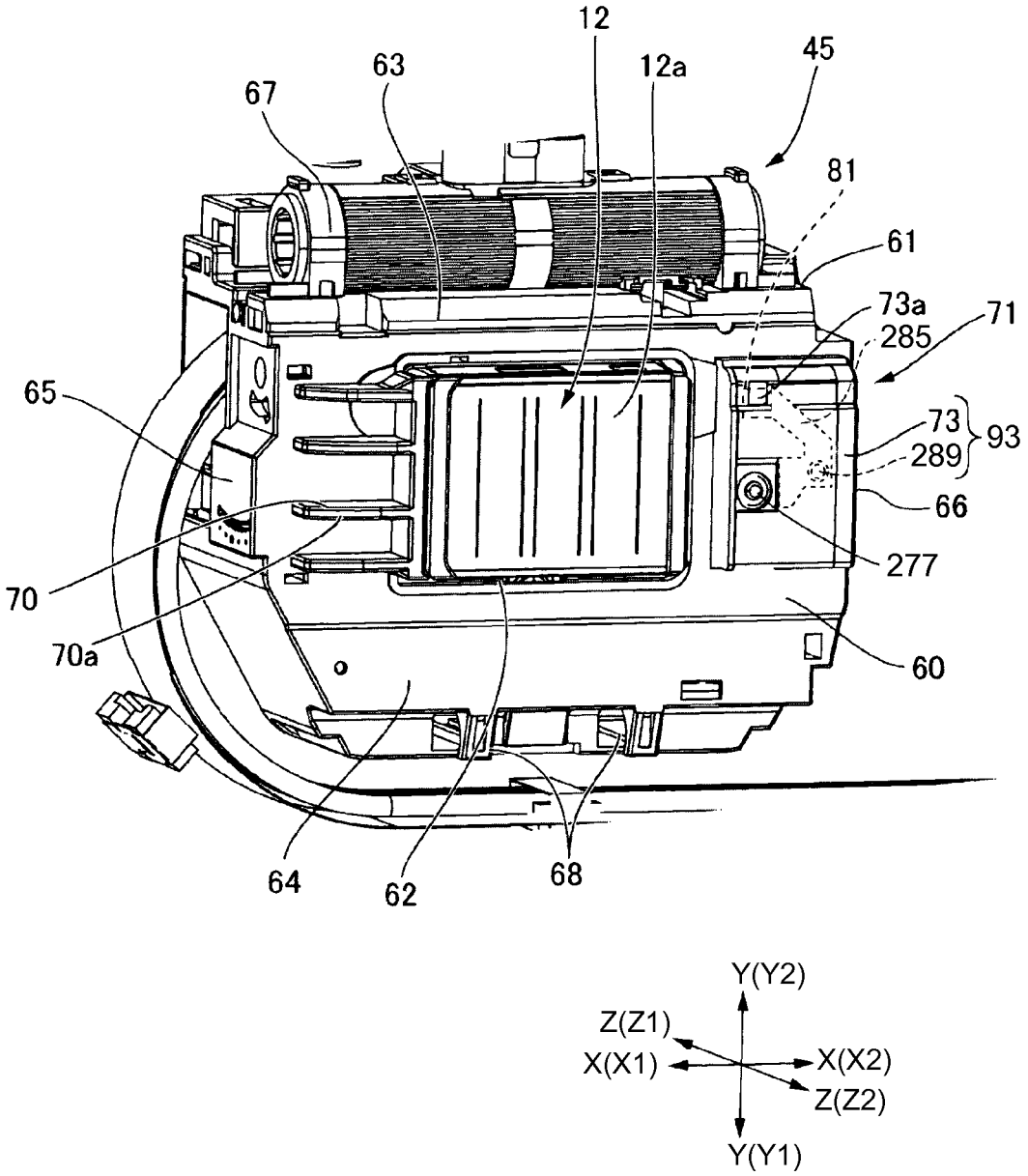
FIG. 19 is an oblique view from below of the carriage with the printhead mounted thereon in a third embodiment of the invention.
Figure 20A:
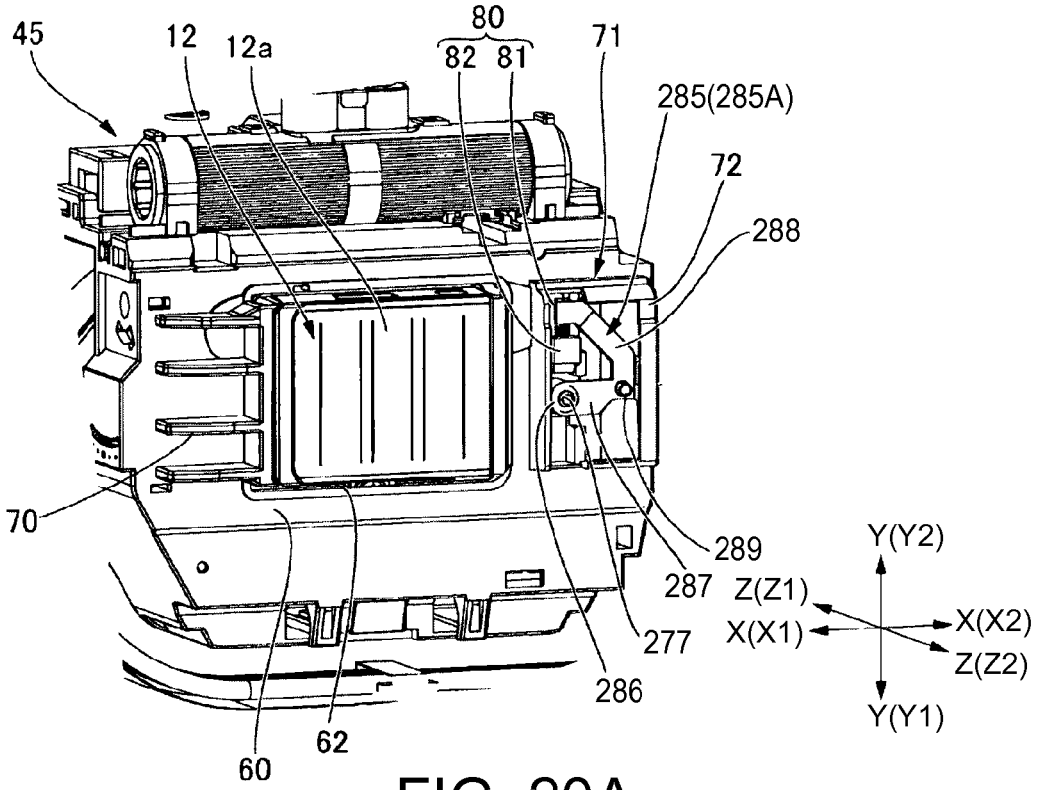
FIGS. 20A and 20B are oblique views from below the carriage 45 with the paper detector cover removed in a third embodiment of the invention.
Figure 20B:
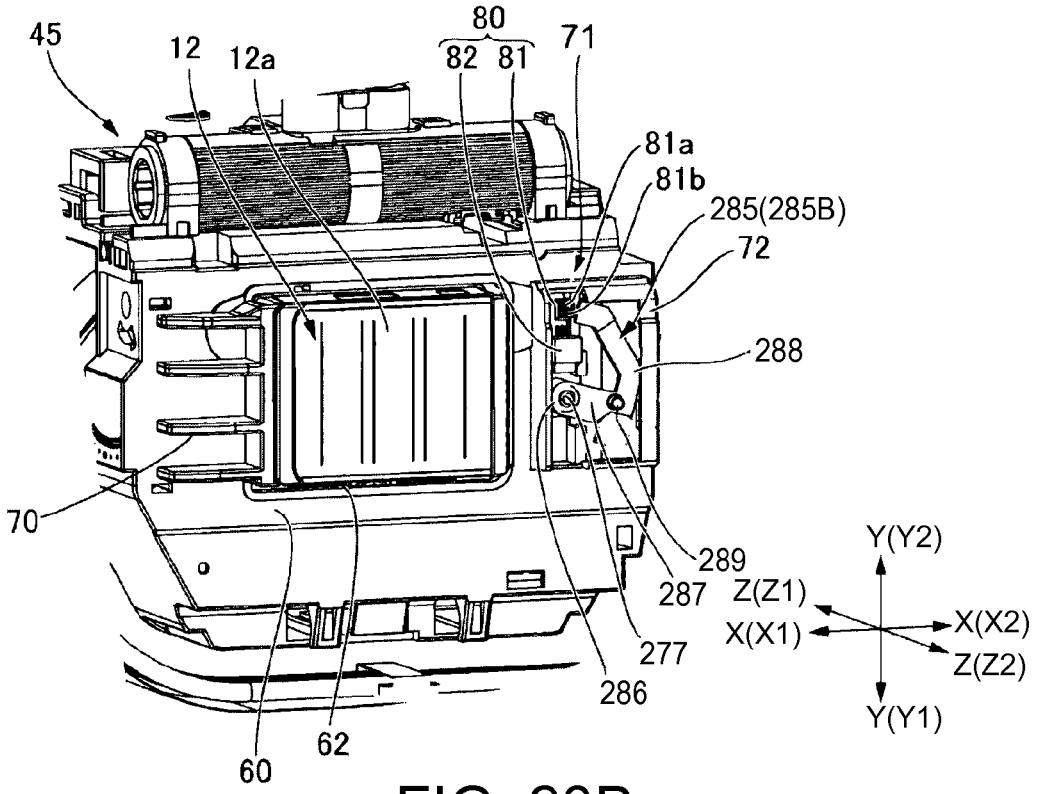
Figure 21:
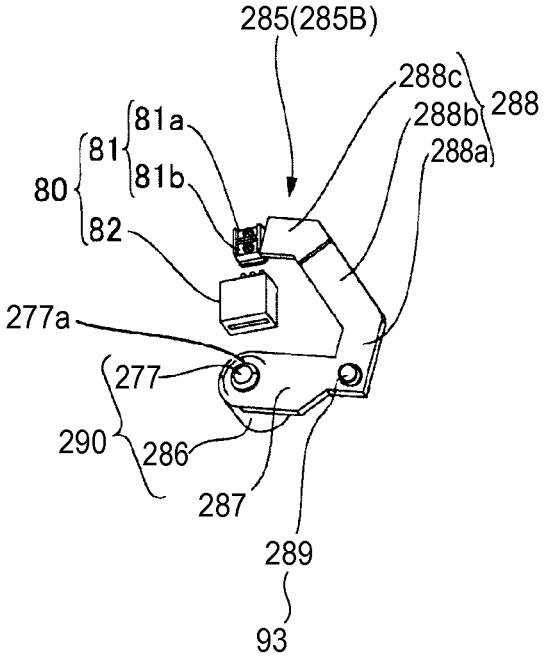
FIG. 21 illustrates the paper detector, the shutter, and the shutter moving mechanism according to a third embodiment of the invention.
Figure 21:
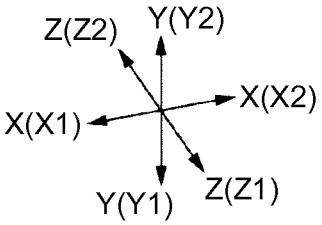
Figure 22:
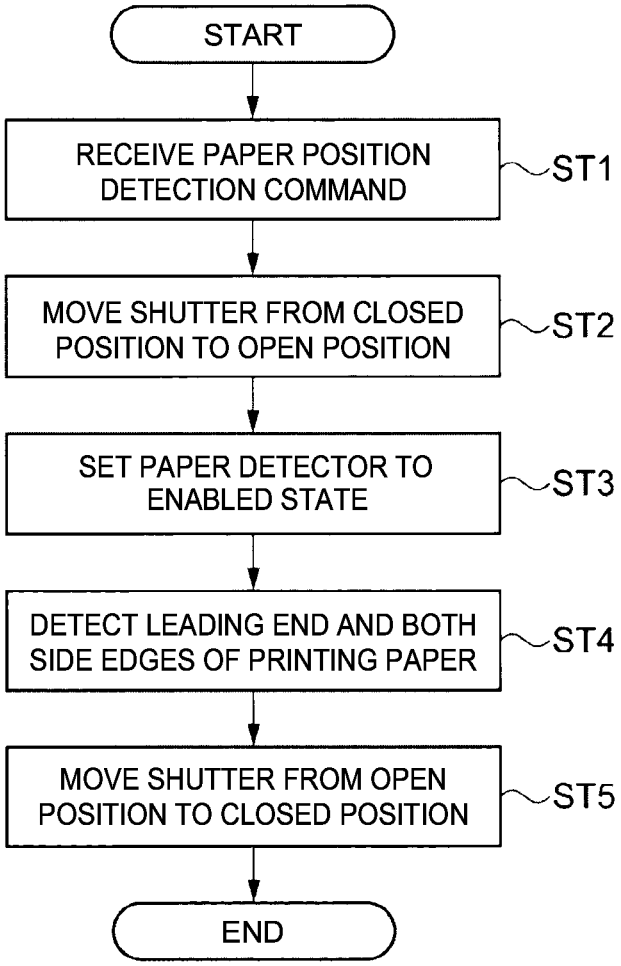
FIG. 22 is a flow chart of the shutter open/close operation and the paper position detection operation according to the third embodiment of the invention.

FIG. 19 is an oblique view from below the carriage with the printhead 12 mounted thereon in a third embodiment of the invention. FIGS. 20A and 20B are oblique views from below the carriage 45 with the paper detector cover 73 removed. FIG. 20A shows the shutter 285 when in the closed position 285A, and FIG. 20B shows the shutter 285 in the open position 285B. FIG. 21 illustrates the shutter 285 and the shutter moving mechanism 290. FIG. 22 is a flow chart of the shutter opening and closing operation, and the paper position detection operation.

Note that like configurations and content in this and the first embodiment are identified by the same reference numerals in FIG. 19 to FIG. 22, and further description thereof is omitted.

As shown in FIG. 19 and FIGS. 20A and 20B, a shutter 285 that opens and closes the detector part 81 of the paper detector 80 is disposed on the paper detector mount 71. The shutter 285 is disposed between the detector part 81 and the detector opening 73*a*. The shutter 285 is supported by the support pin 277 movably between the closed position 285A where the shutter 285 covers the detector part 81 of the paper detector 80, and a an open position 285B where the detector part 81 is not covered. As shown in FIG. 20A, when the shutter 285 is in the closed position 285A, the detector opening 73*a* is covered from above by the shutter 285 (see FIG. 19). As shown in FIG. 20B, when the shutter 285 is in the open position 285B, the shutter 285 moves to a position separated from the detector opening 73*a*. Therefore, when the carriage 45 is seen from below with the shutter 285 in the open position 285B, the detector part 81 is exposed through the detector opening 73*a*.

As shown in FIG. 21, the shutter 285 includes a protruding part 287 that protrudes straight to the outside radially from the support pin 277, and a first arm part 288 that extends substantially horizontally to one direction circumferentially from the end of the protruding part 287.

The first arm part 288 includes a first flat section 288*a* that extends perpendicularly to the protruding part 287, an inclined flat part 288*b* that bends from the distal end of the first flat section 288*a* to the inside toward the support pin 277, and a shutter part 288*c* disposed on the distal end of the inclined flat part 288*b*.

The shutter part 288*c* is the part that intercedes between the detector part 81 and the detector opening 73*a* when the shutter 285 is in the closed position 285A. A support pin 277 fixed at the axis of rotation of an electric actuator 286 is disposed on the opposite end of the protruding part 287 as the end connected to the first arm part 288.

The electric actuator 286 is the power source of the shutter moving mechanism 290. The support pin 277 of the shutter 285 fixed to the rotary shaft of the electric actuator 286 is the transfer mechanism rendering the shutter moving mechanism 290.

By driving the electric actuator 286 forward or reverse, the shutter 285 moves between the closed position 285A and the open position 285B.

The configuration of the shutter moving mechanism 290 is not so limited. More specifically, the pivoting electric actuator 286 may be disposed offset from the support pin 277 of the shutter 285. In this configuration, drive power is transferred using a gear train or other transfer mechanism to the shutter 285 to make the shutter 285 turn. A configuration that causes a shutter with a rotary shaft to turn using a linear motor instead of a rotary type electric actuator is also conceivable. A shutter configured to slide may also be moved forward and back directly using a linear motor. In this configuration, the shutter moving mechanism 290 can be configured with only the linear motor as the drive source without requiring a power transfer mechanism.

Shutter Opening/Closing Operation and Paper Position Detection Operation

FIG. 22 is a flow chart of the operation for opening and closing the shutter 285 and the paper position detection operation.

When print data is supplied to the printer 1 from an external device (a host device not shown), the control unit 54 executes a printing process based on the print data. Print data for executing a precision printing process that requires high positioning precision in the intended print area on the surface of the printing paper P is supplied in this embodiment of the invention. The operation that opens and closes the shutter 285, and the paper position detection operation, are sequentially described below based on FIG. 22.

Step ST1: The print data for a precision printing process includes a paper position detection command, which commands the detection of the position of the leading end of the printing paper P in the first conveyance direction M1, and the positions of both edges of the printing paper P on the transverse axis X. The control unit 54 therefore receives a paper position detection command together with the print data.

Step ST2: When the paper position detection command is received, the control unit 54 opens the shutter 285. More specifically, the control unit 54 outputs a drive signal for driving the electric actuator 286. When the drive signal is received, the electric actuator 286 starts driving and causes the shutter 285 coupled to the drive shaft (support pin 277) to rotate from the closed position 285A to the open position 285B.

When the shutter 285 moves from the closed position 285A to the open position 285B, the shutter 285 moves against the friction acting between the slide pin 289 disposed on the first arm part 288 and the inside surface of the paper detector cover 73. Therefore, after the shutter 285 is moved to the open position 285B, the shutter 285 is held in the open position 285B by the friction acting between the slide pin 289 and the inside surface of the paper detector cover 73. More specifically, the top of the slide pin 289 (the slide part that contacts the inside surface of the paper detector cover 73, see FIG. 19 and FIG. 21) and the inside surface of the paper detector cover 73 (the slide part that contacts the top of the slide pin 289, see FIG. 19 and FIG. 21) are friction surfaces, and function as the position holding mechanism 93 that holds the position of the shutter 285.

Step ST3: After the shutter 285 that covered the paper detector 80 is opened in step ST2, the control unit 54 drives the carriage motor 49 to position over the horizontal conveyance path portion 13*c*, and sets the paper detector 80 to the enabled state. More specifically, the detection beam is emitted from the emitter part 81*a* to the printing paper P, and the photodetector part 81*b* is enabled to detect the reflection.

Step ST4: The control unit 54 drives the paper feed motor 24 and the conveyance motor 36, and conveys the printing paper P from the paper cassette to the print position A. Because the printing paper P reflects the detection beam emitted from the emitter part 81*a* when the printing paper P reaches the print position A, the photodetector part 81*b* can detect the reflected light. Therefore, because whether or not printing paper P is present is detected based on whether or not the photodetector part 81*b* detects the detection beam, the leading end of the printing paper P can be detected. The circuit part 82 amplifies and wave-shapes the output of the photodetector part 81*b*, and outputs to the control unit 54. As a result, the control unit 54 knows that the leading end of the printing paper P on the conveyance path 13 is at the print position A.

When the leading end of the printing paper P is detected, the control unit 54 drives the photodetector part 81*b* to detect the detection beam while driving the carriage motor 49 to move the carriage 45 on the transverse axis X. As a result, because the detector part 81 can detect the printing paper P on the transverse axis X, the control unit 54 can also know the positions of both widthwise edges of the printing paper P on the conveyance path 13 at the print position A.

Step ST5: The control unit 54 then returns the paper detector 80 to the non-detection state (turns the paper detector 80 off) and returns the shutter 285 to the closed position 285A. More specifically, the control unit 54 outputs a drive signal to turn the electric actuator 286, and pivots the shutter 285 from the open position 285B to the closed position 285A.

When the shutter 285 moves from the open position 285B to the closed position 285A, the shutter 285 moves against friction acting between the slide pin 289 disposed on the first arm part 288 and the inside surface of the paper detector cover 73. Therefore, after the shutter 285 is moved to the closed position 285A, the shutter 285 is held in the closed position 285A by the friction acting between the slide pin 289 and the inside surface of the paper detector cover 73. More specifically, the top of the slide pin 289 (the slide part that contacts the inside surface of the paper detector cover 73, see FIG. 19 and FIG. 21) and the inside surface of the paper detector cover 73 (the slide part that contacts the top of the slide pin 289, see FIG. 19 and FIG. 21) are friction surfaces, and function as the position holding mechanism 93 that holds the shutter 285 in position.

As described above, the control unit 54 opens the shutter 285, detects the edges of the printing paper P with the paper detector 80, and then closes the shutter 285 to cover the detector part 81 of the paper detector 80, based on commands from the host device. More specifically, the edges of the printing paper P are detected when the shutter 285 is open and the detector part 81 of the paper detector 80 is open.

A printing process is performed as described in the first embodiment based on received print data.

The printer 1 according to the third embodiment of the invention has a shutter 285 mounted on a carriage 45. The shutter 285 is moved by a shutter moving mechanism 290, and can cover the detector part 81 of the paper detector 80. As a result, ink mist can be prevented from sticking to the detector part 81 even when some of the ink droplets ejected from the printhead 12 become airborne ink mist inside the case 9 before the ink droplets reach the printing paper P. The printer 1 therefore does not need a separate configuration such as a fan and filter for capturing the ink mist. Because space to accommodate such a configuration is also not needed, the size of the printer 1 can be reduced and an increase in the production cost of the printer 1 can be suppressed.

The shutter 285 is also mounted on a carriage 45, is moved by a shutter moving mechanism 290 that receives commands from an external device (a host device not shown in the figures), and opens and closes the detector part 81. The shutter 285 can therefore be freely opened and closed when detecting the printing paper P is necessary.

In this third embodiment of the invention, the shutter 285 is also held in the closed position 285A or the open position 285B by the friction acting between the slide pin 289 disposed on the shutter 285 and the paper detector cover 73. The position holding mechanism 93 of the shutter 285 can therefore be constructed simply.

Note that the paper position detection command may be included in the print data and sent to the control unit 54 as described above, or the paper position detection command may be sent to the control unit 54 separately from the print data at a desired timing from an external device (a host device not shown).

The slide pin 289 that together with the inside surface of the paper detector cover 73 embodies the position holding mechanism 93 may be disposed on the protruding part 287. The slide pin 289 may also be disposed on a surface (a surface on the opposite side as the surface opposing the paper detector cover 73) of the first arm part 288 or the protruding part 287 opposing the carriage 45. In this configuration, the slide pin 289 slides against the carriage 45, and the shutter 285 is held in the open position 285B by the friction acting between the slide pin 289 and the carriage 45. A configuration in which at least one of the first arm part 288 and the protruding part 287 slides against the inside surface of the paper detector cover 73 or the carriage 45 without using a slide pin 289 is also conceivable.

Further alternatively, the position holding mechanism 93 may be a detent mechanism having a protruding part disposed on the carriage 45 or the shutter 285, and a catch disposed on the other of the carriage 45 and shutter 285 to catch the protruding part. In this event, the detent mechanism can be configured between the shutter 285 and the bottom section 60 of the carriage 45, or between the shutter 285 and the paper detector cover 73.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer comprising:

a conveyance path that conveys printing paper in a first direction;

a printhead that ejects ink and prints on the printing paper;

a carriage that carries the printhead;

a carriage moving mechanism that moves the carriage in a second direction perpendicularly to the first direction;

a paper detector that is disposed to the carriage and has an emission part that emits light and a detection part that detects light;

a shutter that moves between a closed position covering the detection part of the paper detector, and an open position different from the closed position;

a shutter operating member that moves the shutter when the carriage is in a specific position;

a frame opposite the carriage; and the shutter operating member being disposed to the frame.

2. The printer described in claim 1, further comprising:

a platen opposite the printhead; and a second carriage moving mechanism that moves the carriage between a first distance and a second distance that is greater than the first distance, the first distance and the second distance being the distance between the platen and the printhead.

3. The printer described in claim 2, wherein:

the shutter operating member moves the shutter when the distance between the platen and the printhead is the first distance.

4. The printer described in claim 3, further comprising:

a second shutter operating member that moves the shutter when the distance between the platen and the printhead is the second distance.

5. The printer described in claim 4, wherein:

as the carriage moves to one end of the range of movement in the second direction, the shutter operating member moves the shutter from the open position to the closed position.

6. The printer described in claim 5, wherein:

as the carriage moves to the one end, the second shutter operating member moves the shutter from the closed position to the open position.

7. The printer described in claim 6, wherein:

the shutter operating member is disposed on one side of the second direction; and the second shutter operating member is disposed on the other side of the second direction.

8. The printer described in claim 1, further comprising:

a paper detector cover;

a slide pin, wherein the shutter is held in the closed position and in the open position by friction that acts between the slide pin and an inside surface of the paper detector cover.

* * * * *